US005325772A

United States Patent [19]

McChesney

[11] Patent Number: 5,325,772

[45] Date of Patent: Jul. 5, 1994

[54] POSTAGE METER

[75] Inventor: Hugh McChesney, Hertfordshire, England

[73] Assignee: Pitney Bowes plc, Harlow, England

[21] Appl. No.: 160,109

[22] Filed: Nov. 24, 1993

[30] Foreign Application Priority Data

Sep. 21, 1990 [GB] United Kingdom ..... 9020633

[51] Int. Cl.[5] ..... B41J 1/34

[52] U.S. Cl. ..... 101/76; 101/110

[58] Field of Search ..... 101/72, 76, 77, 85, 101/86, 87, 91, 109, 110; 364/464.02; 235/1 D, 58 R, 432

[56] References Cited

U.S. PATENT DOCUMENTS

| | | | |
|---|---|---|---|
| 3,965,815 | 6/1976 | Lupkas et al. | 101/110 |
| 4,050,374 | 9/1977 | Check | 101/110 |
| 4,398,458 | 8/1983 | Denzin et al. | 101/91 |
| 4,603,627 | 8/1986 | Pollak, Jr. et al. | 101/91 |
| 4,649,814 | 3/1987 | Sette | 101/91 |
| 4,701,685 | 10/1987 | Gruner | 400/322 |
| 4,809,186 | 2/1989 | Freeman | 101/91 |

FOREIGN PATENT DOCUMENTS

| | | |
|---|---|---|
| 0177049 | 4/1986 | European Pat. Off. . |
| 0177050 | 4/1986 | European Pat. Off. . |
| 2102346 | 2/1983 | United Kingdom . |
| 2166389 | 5/1986 | United Kingdom . |

*Primary Examiner*—J. Reed Fisher

*Attorney, Agent, or Firm*—Charles G. Parks, Jr.; Melvin J. Scolnick

[57] ABSTRACT

A postage meter has a print drum assembly which includes a print drum and a drum shaft. The drum includes selectively settable value printing elements. The drum shaft has, located in one or more grooves therein, a plurality of linearly movable racks. These racks are connected to the value printing elements in such a manner that linear movement of one rack alters the position of a corresponding value printing element. The meter also has a plurality of gears, called cross-over gears, arranged to drive corresponding racks. The cross-over gears driving the racks in the or each groove are arranged side-by-side and are independently driven by respective drive components arranged for rotation about a rotation axis common to the cross-over gears and the drive components.

10 Claims, 17 Drawing Sheets

FIG.2g
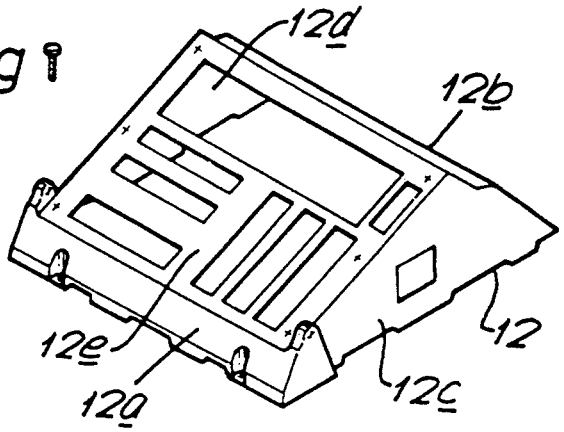
FIG.2a
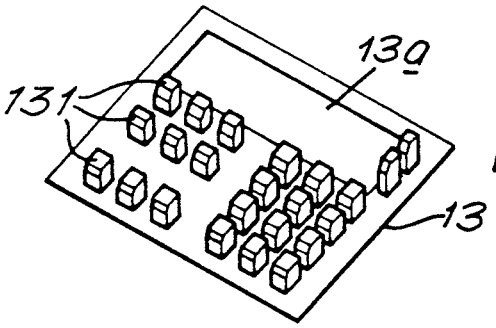
FIG.2b
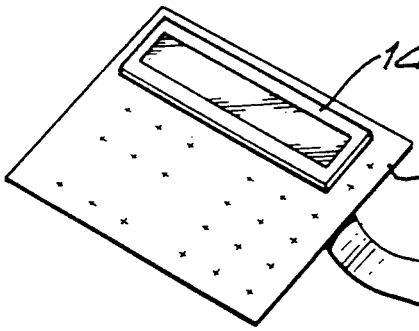
FIG.2c
FIG.2d
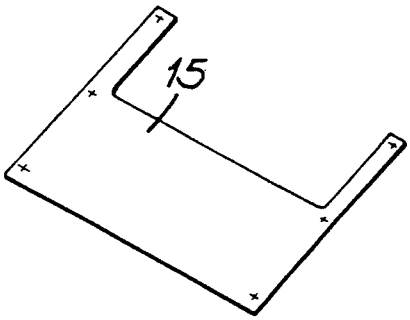
FIG.2e
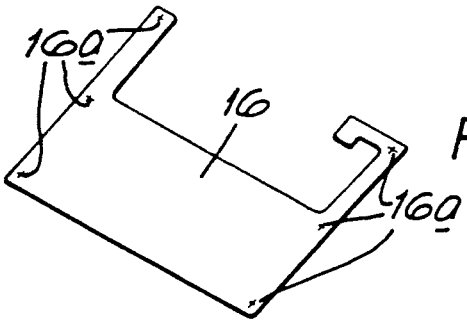
FIG.2f 83
85
84
85
81
85
82
85
831
715
811
716
713
716
711
732
713
71
734
733
731
735
736
737
738
739
732
73

86
85
861
85
87
88
85
871
85
85
862
863
881
85
872
723
873
72
743
742
882
883
721
7442
741
744
7441
745
746
7411
747
749
7412
748
7410
74
742

FIG.19.
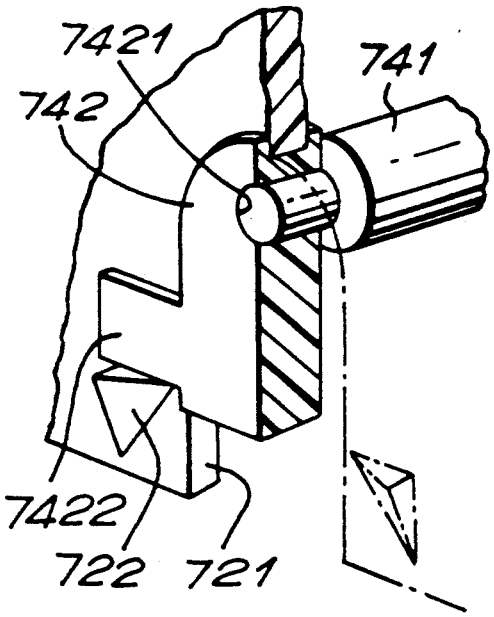
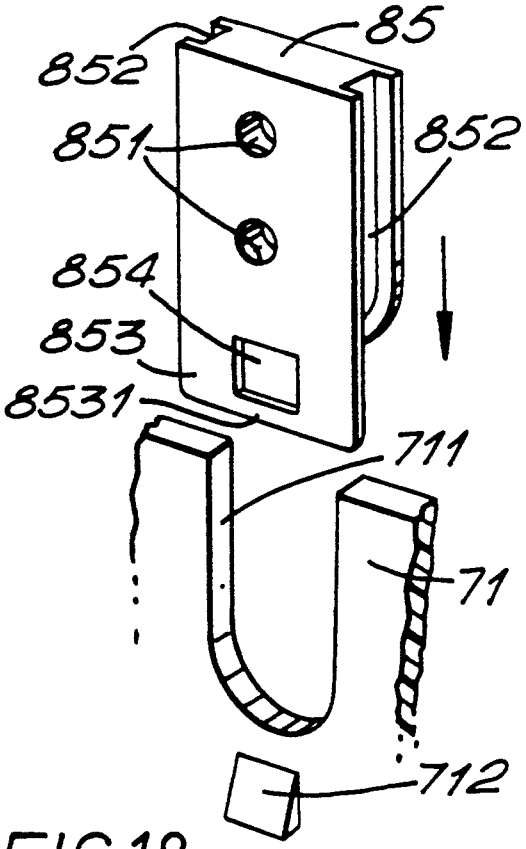
FIG.18.
FIG.20.
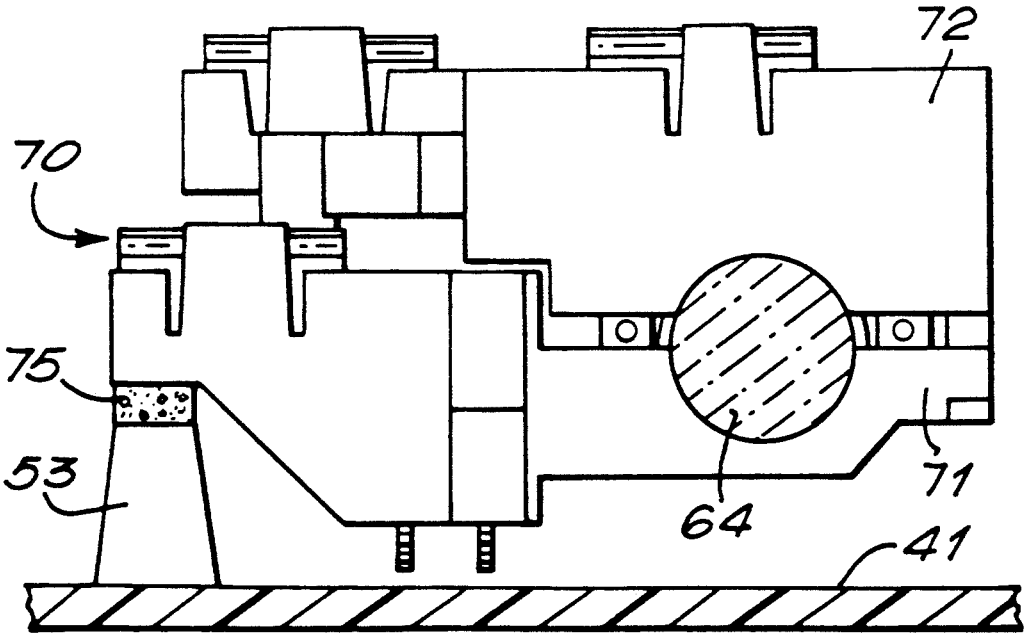

POSTAGE METER

This invention relates to a postage meter. The term "postage meter" in this specification is used to mean any franking machine or value symbol issuing meter which can apply to articles symbols or legends which denote a particular value, which may for example be the cost of transporting the article to a defined destination, and which also keep a secure cumulative record of value dispensed. The term is not intended to be restricted to the issuing of value in connection with transport of mail pieces by the Postal Authorities. "Postage meters" as described herein could be employed equally well by private couriers.

In this context a value symbol or legend may be any of one or more digits making up a number, one or more alphabetical symbols, other geographical symbols, or magnetically or electrically or optically readable symbols.

Postage meters have been known for a considerable time. An early machine is described in British Patent No. 272 273. An important more recent development is the availability of electronic postage meters. A pioneer electronic postage meter is described in British Patent No. 1 492 704.

A typical postage meter includes the following principal components: a means of printing selectable value symbols, a means of keeping account of value symbols printed, and a keyboard or other input means whereby a user can set the amount of value which the machine is to print.

An aim of the present invention is to provide a postage meter in which a neat and compact, yet effective, arrangement is provided for selectively setting the positions of value symbols to enable the printing of a desired value amount on a mailpiece or other article to be transported.

According to the invention, there is provided a postage meter comprising: a print drum assembly which includes a print drum and a drum shaft, the drum including selectively settable value printing elements and the drum shaft having, located in one or more grooves therein, a plurality of linearly movable racks connected to the value printing elements in such a manner that linear movement of one rack alters the position of a corresponding value printing element; and a plurality of gears, herein called cross-over gears, arranged to drive corresponding racks; characterised in that the cross-over gears driving the racks in the or each groove are arranged side-by-side and are independently driven by respective drive components arranged for rotation about a rotation axis common to the cross-over gears and the drive components.

In a preferred embodiment of the invention, the drum shaft has two axial grooves symmetrically disposed at opposite ends of a shaft diameter, and the first groove thereof contains either two or three racks and the second groove thereof contains two racks.

According to a preferred embodiment of the invention, a rack drive assembly for driving two side-by-side racks in a groove comprises: a first gear, a splined shaft, and a first one of the cross-over gears in driven relationship with the splined shaft, these components being arranged to drive one of the two racks; and a second gear, a pair of sleeves surrounding and freely rotatable relative to the splined shaft, and a second one of the cross-over gears, these components being arranged to drive the other one of the two racks, the sleeves being interengaged so that rotation of one causes rotation of the other, there being a first dog engagement between the second gear and one of the pair of sleeves and a second dog engagement between the other of the sleeves and the second cross-over gear, a spring biassing means being included to urge the two sleeves apart.

In the present specification, the sleeves referred to are also termed "half shafts".

With such an arrangement there exist two independent drive paths, one from the first gear via the splined shaft to the first cross-over gear, resulting in linear movement of the first rack relative to the drum shaft, and a second drive path from the second gear to the second cross-over gear via the first dog engagement, the first sleeve, the second sleeve, and the second dog engagement, resulting in linear movement of the second rack relative to the drum shaft.

A feature of the present invention is that (unlike all prior postage meters known to the Applicant) the construction of the drum shaft and rack drive arrangements is versatile in that essentially the same shaft and rack drive can be employed for both 4-bank and 5-bank meters. That is to say, some countries require 4-digit value symbols to be franked, whereas other countries require 5-digit value symbols. Consequently in the past two different meters have been manufactured to meet these distinct customer requirements. It will be appreciated that a 4-bank meter would have 4 value printing elements making up a print head, and these would be selectively driven by 4 corresponding racks. A 5-bank meter would likewise have 5 value printing elements and 5 corresponding racks. The meter shown in European Patent Application Publication No. 221 553 is an example of a meter limited to 4 value printing symbols. However, with the arrangement according to the invention, one can choose not to operate the 5th rack, and to dispense with the 5th value printing element. Hence one basic design of meter according to the invention can serve both purposes.

According to a particular embodiment of the invention, a rack drive assembly for driving three side-by-side racks in a groove comprises: a first gear, a first sleeve, a second sleeve in drive engagement therewith and a first one of the cross-over gears, these components being arranged to drive a first one of the three racks; a second gear, a splined shaft, and a second one of the cross-over gears, the splined shaft being in driving engagement with the second gear and in driven engagement with the second cross-over gear, these components being arranged to drive a second one of the three racks; and a third gear, a hollow spacer surrounding and freely rotatable relative to the splined shaft, and a third one of the cross-over gears, the components being arranged to drive a third one of the three racks, there being a first dog engagement between the third gear and the spacer and a second dog engagement between the spacer and the third cross-over gear, whereby the third gear is in driving engagement with the spacer and the spacer is in driving engagement with the third cross-over gear.

An advantageous feature of this arrangement is that a spring biassing means, e.g. a helical compression spring, may be disposed to act between the two sleeves in such a manner as to urge them apart. The spring may encircle the splined shaft. This arrangement takes up any tolerance in an axial direction and ensures that the various drive components properly engage each other in the manner stated, in use of the meter. Of course, spacer rings may be included if necessary to achieve a proper location of the cross-over gears relative to the racks.

According to an advantageous embodiment of the invention, the or each splined shaft may be located in a gearbox housing by snap-in bearing retainer clips. These allow a particularly convenient and easy assembly of gearbox parts during manufacture.

Preferably, at least one of the gears used to drive the cross-over gears is an encoder gear. A particularly advantageous design of encoder gear has peripheral gear teeth and, radially inwardly of these, an outer and an inner circular array of apertures. These arrays co-operate with respective outer and inner light beams and respective sensors. For reasons which will be explained later, it is desirable to blank out (fill in) one outer and one inner aperture. This permits the use of greater manufacturing tolerences without loss of accuracy in the information on the encoder disc position provided by the arrays of apertures, the light-beams and the sensors.

The invention will be better understood from the following non-limiting description of an example thereof given with reference to the accompanying drawings in which:

FIG. 1 is an overall perspective view of a postage meter when mounted on a postage meter base with which it is, in use, used;

FIGS. 2*a*–2*g* show in perspective exploded view various components which make up a first assembly of an upper internal unit of the meter of FIG. 1;

FIG. 18 shows a bearing clip of the type used in supporting a reduction gear assembly associated with a motor used to drive an encoder gear;

FIG. 19 shows a bearing clip of the type used to support the splined drive shafts of the upper and lower rack drive assemblies;

FIG. 20 is a diagrammatic view of the gear box assembly;

Figure 22:
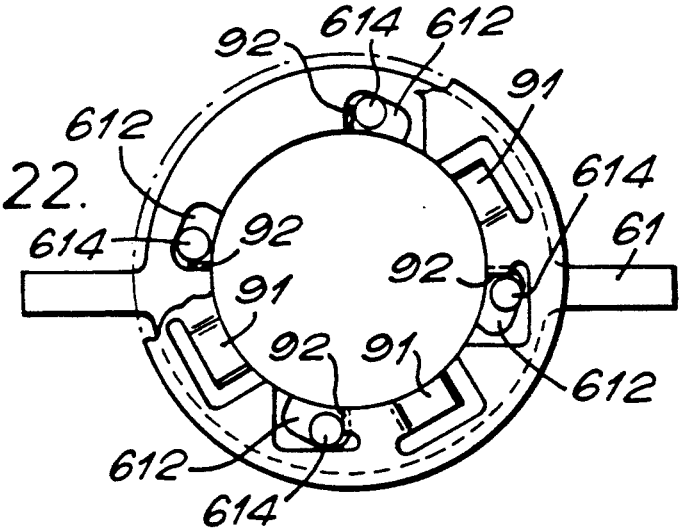
FIG. 22 is a plan view of the components of the limited backlash clutch.
Figure 22A:
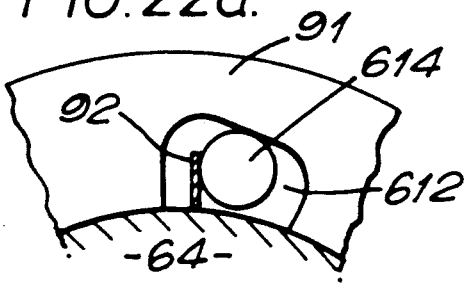
Figure 22B:
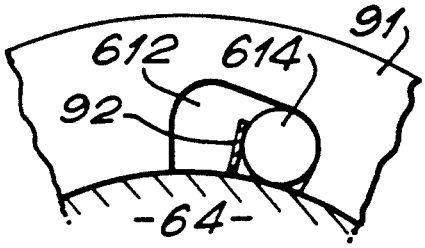
Figure 23:
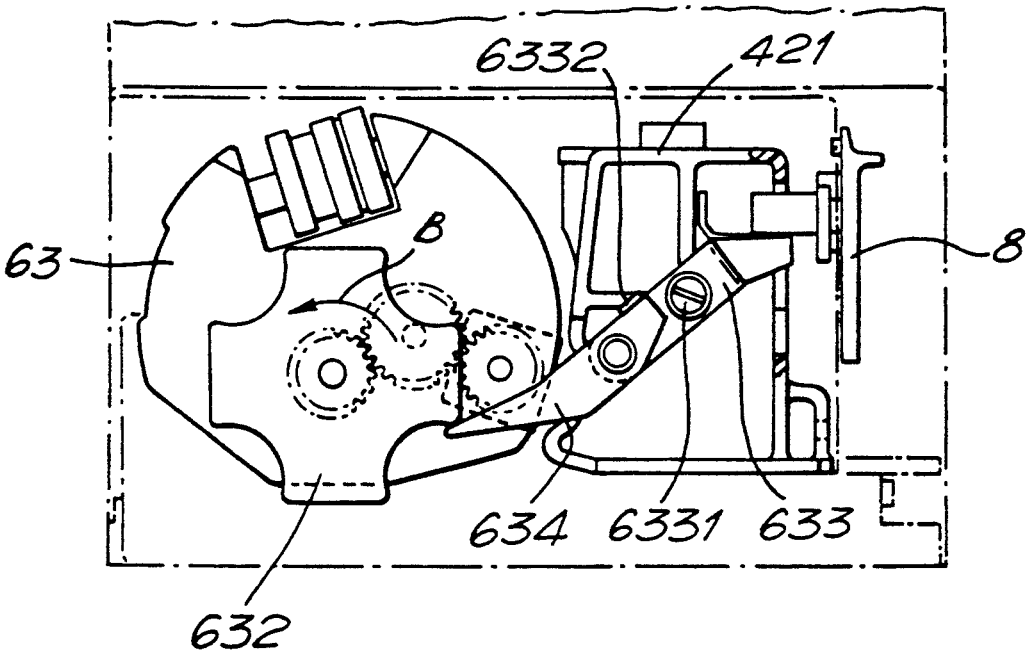
Figure 23A:
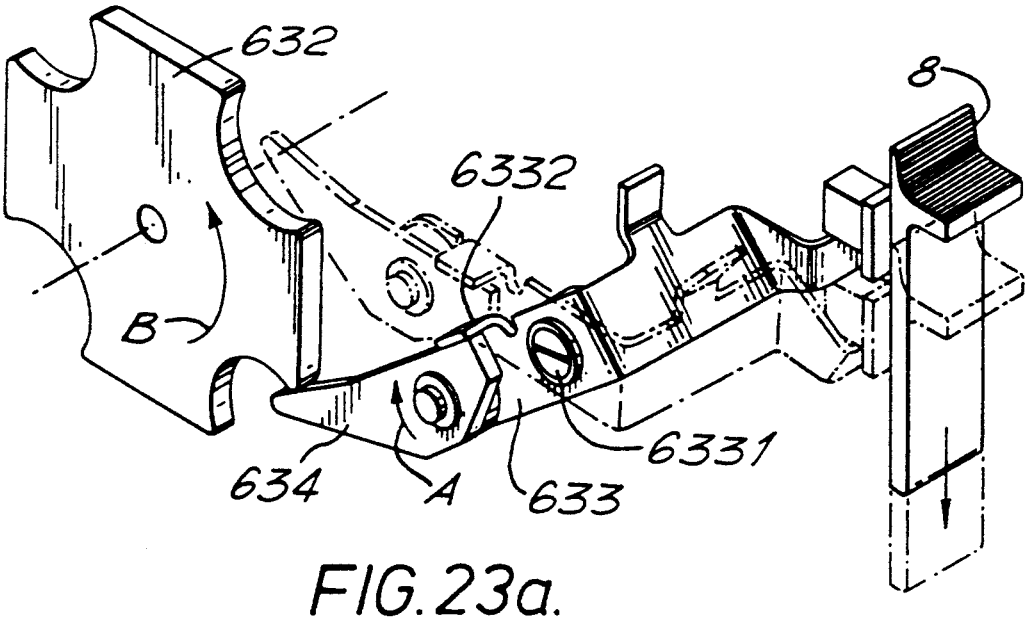

FIGS. 22*a* and 22*b* are enlarged views showing different positions of the limited backlash clutch when in operation;

FIG. 23 is a side view of a multi-slogan change apparatus which acts on the print drum 63; and, FIG. 23*a* is a diagrammatic perspective view of the multi-slogan change apparatus.

The postage meter 1 is intended to be capable of being used with a range of known postage meter bases 2.

The postage meter 1 comprises a main cover 3, a hingeable drum cover 4 and a carrying handle 5. The drum cover 4 is pivotable to expose a print drum which prints postage. The print drum will be described later.

In use, postage is printed on a mailpiece by passing the mailpiece along a path P running along the top of the postage meter base 2 and underneath the print drum.

The postage meter 1 also includes a power input socket 6 and an on-off switch 7. Buttons 131 of a key pad 13 (see FIG. 2*b*) are accessible at the top of the postage meter 1 in order to control the functioning of the postage meter. For example, the buttons 131 are used to input the amount of postage to be printed on the mailpiece; to check the value of the ascending register of total postage value printed; to check the descending register of remaining postage value available for use; to control the replenishment of postage value stored in the meter; to enter and subsequently use memory functions such as frequently used postage values; and to perform other control and diagnostic functions. A display 14 is provided in order to present information to the user.

The overall control system is described in U.S. patent application Ser. Nos. 07/423,813, now abandoned and 07/423,822 now U.S. Pat. No. 5,121,327.

A slidable knob 8 is provided for controlling a multi-slogan change device on the print drum. Further details are given later.

Within the main cover 3 are located two main internal units: an upper internal unit and a lower internal unit.

The upper internal unit contains logic circuitry including a computer for controlling postage meter functions.

DESCRIPTION OF UPPER INTERNAL UNIT

Figure 3:
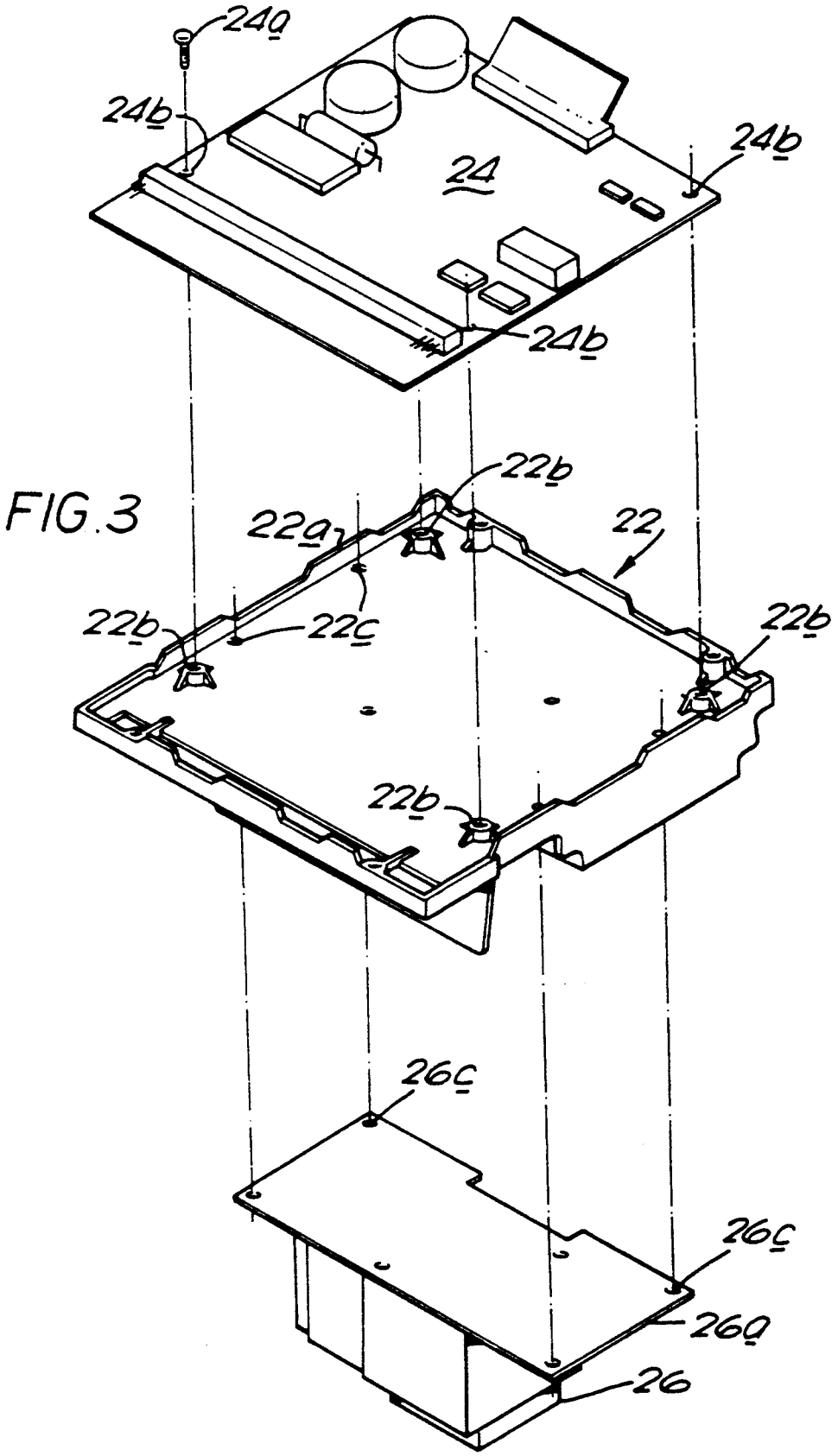
FIG. 3 is a perspective exploded view showing components which make up a second assembly of the upper internal unit.
Figure 4:
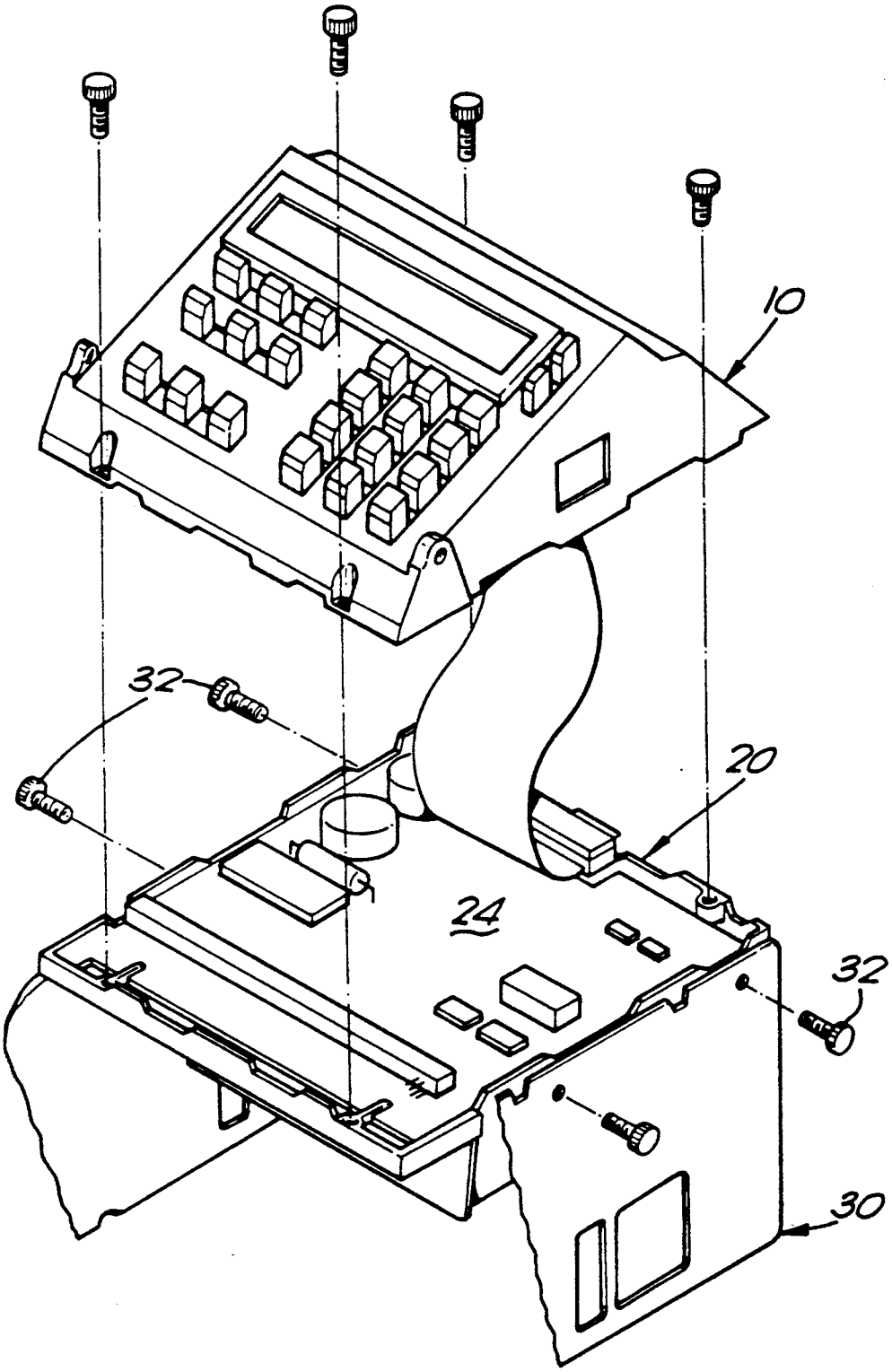
FIG. 4 is a perspective exploded view showing the first assembly about to be united with the second assembly and with side plates, to produce the upper internal unit.

Referring firstly to FIGS. 2*a*–2*g*, these Figures illustrate the components of a first assembly 10. The subject matter of FIGS. 2, 3 and 4 is embodied in our U.K. Patent Application Publication No. 2236627. No claim to this subject matter is made in the present application. In general terms the upper internal unit is made up of a first assembly 10 (FIG. 4) and a second assembly 20 (FIG. 4). The first assembly 10 comprises a first die casting 12 having a front wall 12*a*, a rear wall 12*b*, side walls 12*c* and 12*d*, and a top wall 12*e*. The top wall 12*e* has apertures therein. The next component of the first assembly is the key pad 13 having an aperture 13*a* therein. Beneath the key pad 13 is positioned the display 14 and a display printed circuit board 14a. The display 14 is connected to a flying ribbon 14b. An insulating plate 15 is located beneath the board 14a and beneath this is located a metal support plate 16. The parts 12, 13, 14a, 15, 16 have aligned holes 16a therein, so that they can be connected together as a unit by suitable screws or bolts. One such bolt is illustrated in FIG. 2g.

The second assembly 20 comprises a second die casting 22, a main logic board 24, and a power supply unit 26. These are all seen in FIG. 3. The second die casting is a generally planar die casting of a particular shape designed to co-operate and interfit with the first die casting 12. For this purpose it has an upstanding rim 22a and is provided with appropriately positioned through holes 22b. The main logic board has through holes 24b which are aligned in registry with the holes 22b of the die casting, so as to permit assembly. A so-called "Taptite" screw 24a for effecting this connection is shown at the top of FIG. 3. Three other screws (not shown) are also used.

The second die casting 22 also has through holes 22c which are arranged in registry with holes 26c in printed circuit board 26a which is attached to the power supply unit 26. The holes 22c, 26c permit assembly using screws.

FIG. 4 illustrates the two assemblies 10 and 20, and this figure also shows side plates 30 which are attached to the second die casting 22 by self tapping screws 32. The screws 32 may be "Taptite" screws. The plates 30 are of metal and serve as part of a heat sink which includes the die casting 22 and, to a lesser extent, the die casting 12. The close physical connection between the parts 12, 22 and 30 permits heat generated in the power supply unit 26 to be effectively dissipated so avoiding undesirable over-heating.

It will be appreciated that modifications may be made to the disclosed and illustrated arrangement. For example, fastening clips or other securing means could be employed if desired to connect together the first and second die castings 12 and 22.

By using die castings in the upper internal unit, it is no longer necessary to perform complex sheet forming and other operations on sheet metal. In addition to acting as a heat sink, the parts 12, 22 and 30 also provide shielding against radio frequency interference and electromagnetic induction effects which might affect the working of the components on the main logic board 24.

LOWER INTERNAL UNIT

Figure 1:
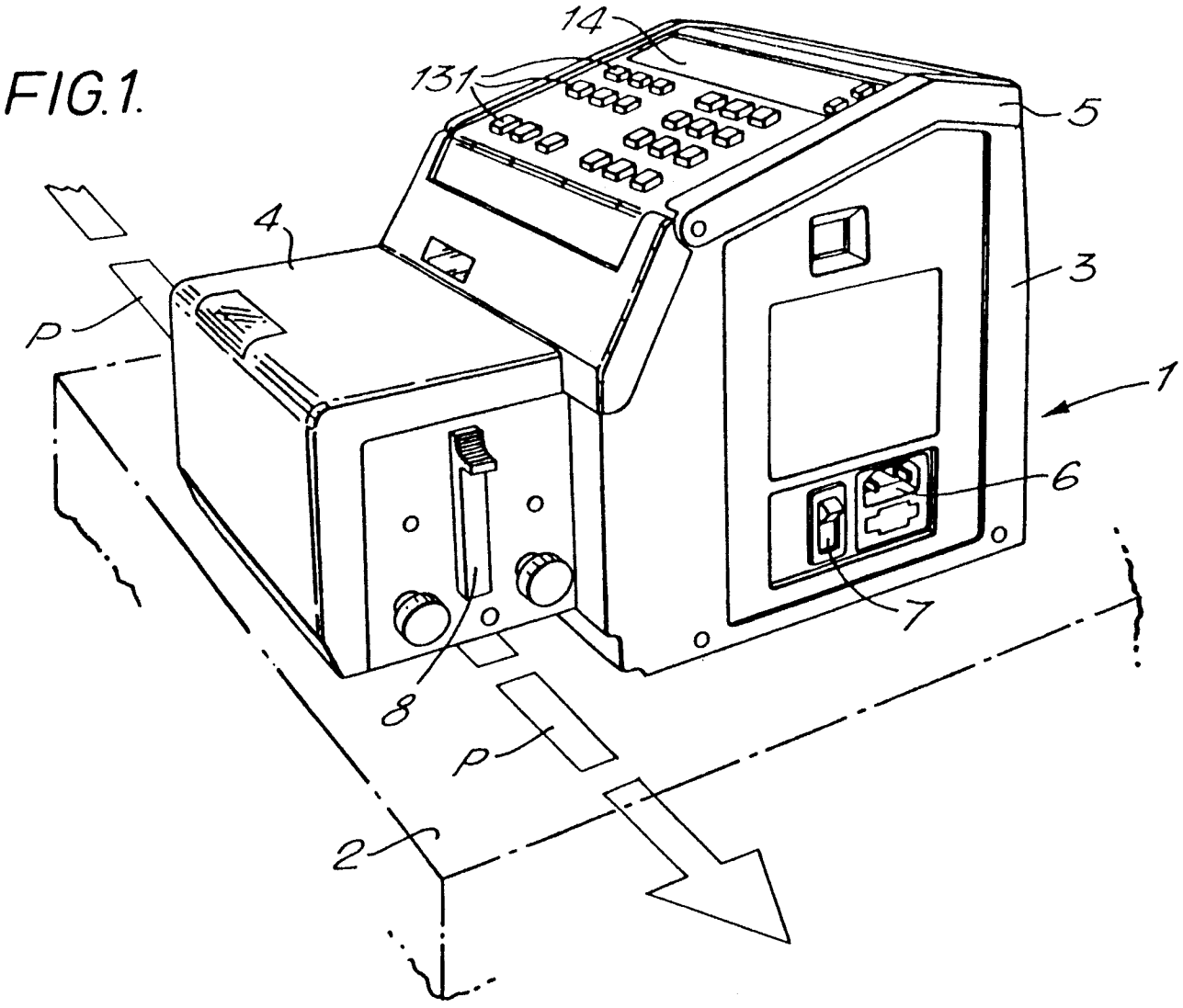

Referring to FIGS. 5 to 9, the lower internal unit includes a base unit 40 which forms the overall base of the postage meter 1 and which is, in use, positioned on top of the underlying postage meter base 2 with which the postage meter 1 is used (see FIG. 1). The base unit 40 comprises a base plate 41 and two upwardly extending walls 42. When the upper internal unit (shown in FIGS. 2 to 4) is assembled onto the lower internal unit, the bottommost edges of the side plates 30 sit on the base plate 41 and extend between the walls 42.

A latch mechanism 50 of generally known design is mounted on the base plate 41 and includes three tumblers 51 which receive upwardly extending projections of the postage meter base 2 when the postage meter 1 is mounted thereon. The projections of the postage meter base 2 are locked into the tumblers 51 by movable plates 52. This arrangement follows a known design.

The walls 42 of the base unit 40 contain concave bearing support surfaces 43 and 44. The bearing support surfaces 43, 44 receive, in the assembled postage meter, rear and front bearings 61 and 62 respectively of a print drum assembly 60 (see FIG. 5). The bearings 61, 62 rotatably support a print drum 63 and drum shaft 64 which rotate together. The print drum 63 contains, in a known manner, a bank of five rotatable digit wheels 631. At any one time, each digit wheel 631 presents a selectable one of its digits 0 to 9 so that, by rotating all five wheels 631, a selected postage value may be displayed. Then, when the print drum 63 rotates, the displayed postage value may be printed on the mailpiece as it passes underneath the drum 63 along the path P (see FIG. 1).

The digit wheels 631 are adjusted in a known manner by five longitudinally slidable racks 641 (see FIG. 5) that are located in the drum shaft 64. Each rack 641 controls a respective one of the digit wheels 631, so that longitudinal movement of the rack is converted into rotational movement of the digit wheel. This changes the digit that the wheel presents for printing and thereby alters the postage value to be printed.

The drum assembly 60 includes a drive gear 65 for rotatably driving the drum shaft 64 and print drum 63. The bottom part of the drive gear 65 projects through an aperture 45 (most clearly seen in FIG. 7) in the base plate 41. This arrangement permits the drive gear 65 to be accessible to the postage meter base 2, when the postage meter 1 is mounted thereon, so that the postage meter base may rotatably drive the drive gear 65 and thereby cause rotation of the print drum 63.

The drum shaft 64 includes a toothed portion 642 adjacent to the drive gear 65. This toothed portion 642 drives an encoder disc 46 which is rotatably mounted on the base plate 41 (see FIGS. 7 to 9). The encoder disc has a circumference twice that of the toothed portion 642 and therefore completes a half revolution for every whole revolution of the print drum 63/drum shaft 64. Because it is desired to know when the print drum 63 has completed one revolution and returned to its "home" position, the encoder disc 46 is provided with two slots 461. The slots 461 are on different radii and are approximately diametrically opposite one another. A detector unit 47 straddles the rim of the encoder disc 46 so as to detect the slots 461 by means of interrupted light beam arrangements. The detector unit 47 is connected to the main logic board 24 so as to inform the circuitry in the logic board as to when the print drum 63 has completed a full revolution and returned to its home position.

A shutter bar 48 is slidably mounted on the base plate 41 and has an end 481 which projects into a slot 651 (see FIG. 21) of the drive gear when the print drum 63 is in its home position. In this way, the print drum 63 is prevented from moving.

In order to permit the drive gear 65 to be rotatably driven so as to rotate the print drum 63, the shutter bar 48 is slid so as to retract its end 481 out of the slot 651 in the drive gear 65. This is done by a known mechanism (not shown) under the control of the main logic board 24. The shutter bar 48 includes a projection 482 which extends into an interposer unit 49 so that the shutter bar 48 may be held locked in its locking position. Thus, before the shutter bar 48 may be retracted, the interposer unit 49 must be activated by the main logic board 24 so as to release the projection 482.

The shutter bar 48 and interposer unit 49 have their positions optically sensed by optical sensor means (not shown).

GEARBOX ASSEMBLY

The gearbox assembly 70 comprises a lower portion 71 and an upper portion 72. Both portions are made out of injection moulded plastics material.

Figure 10:
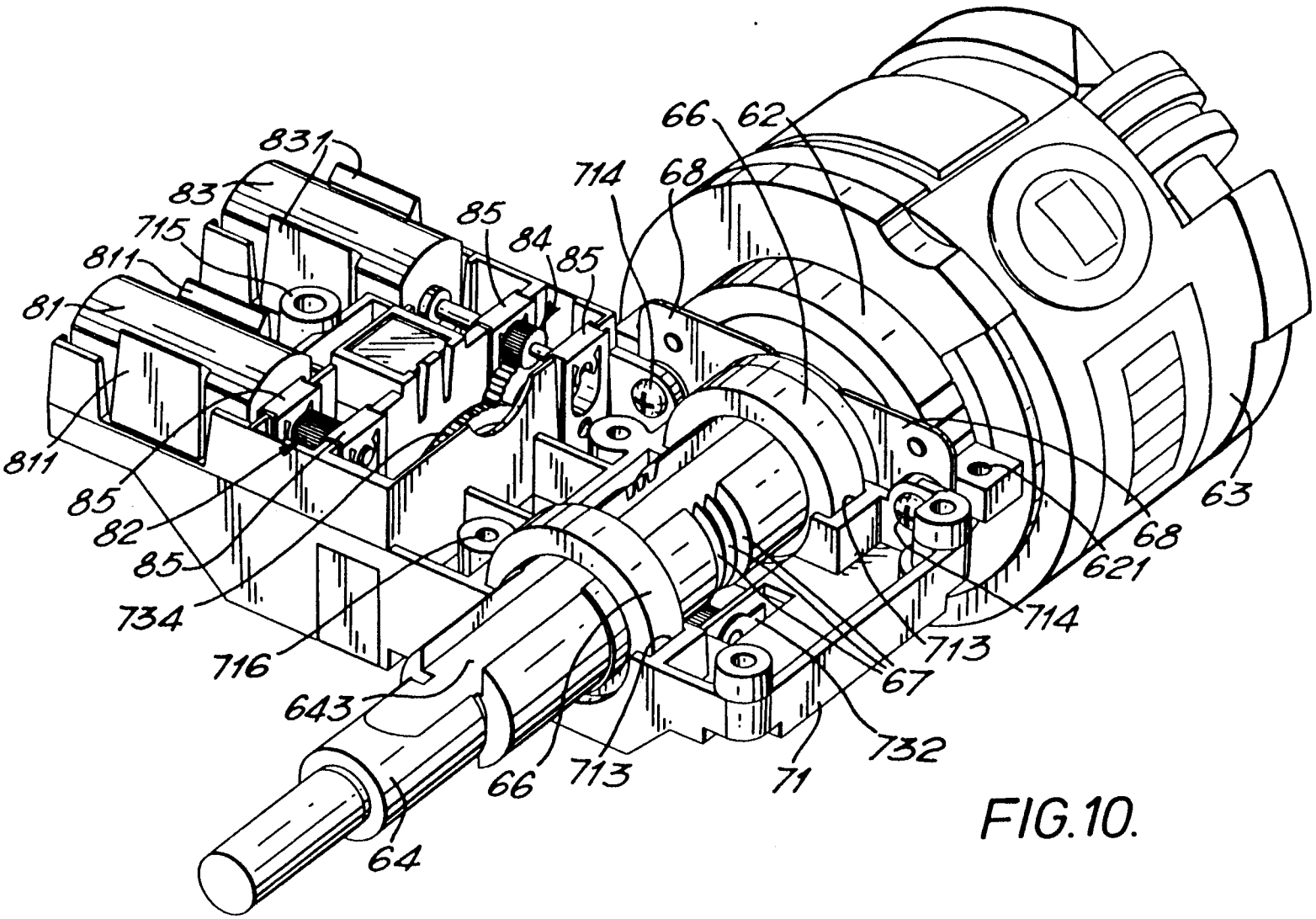
FIG. 10 is a perspective view of the print drum and drum shaft assembled with the lower half of the gearbox assembly.

The gearbox assembly is provided in order to drive the five racks 641 in the drum shaft 64. Referring to FIG. 10, there is shown a slot 643 in the drum shaft 64 in which three of the five racks are, in practice, located, although they are not actually shown in that Figure. There is a corresponding slot on the underside of the drum shaft 64 as viewed in FIG. 10 which contains the remaining two of the five racks 641. As explained previously, the longitudinal position of the racks determines the rotational position of the corresponding five digit wheels in the print drum 63 so that the postage value to be printed may be varied.

In order to drive the five racks 641, the gearbox assembly contains two rack drive assemblies. A first one of the rack drive assemblies 73 is located in the lower gearbox portion 71 and extends underneath the drum shaft 64 so as to drive the two lowermost racks 641. An upper rack drive assembly 74 is located in the upper gearbox portion 72 and extends over the drum shaft 64 so as to drive the three racks 641 in the upper part of the drum shaft.

GEARBOX RACK DRIVE ASSEMBLIES

Figure 11:
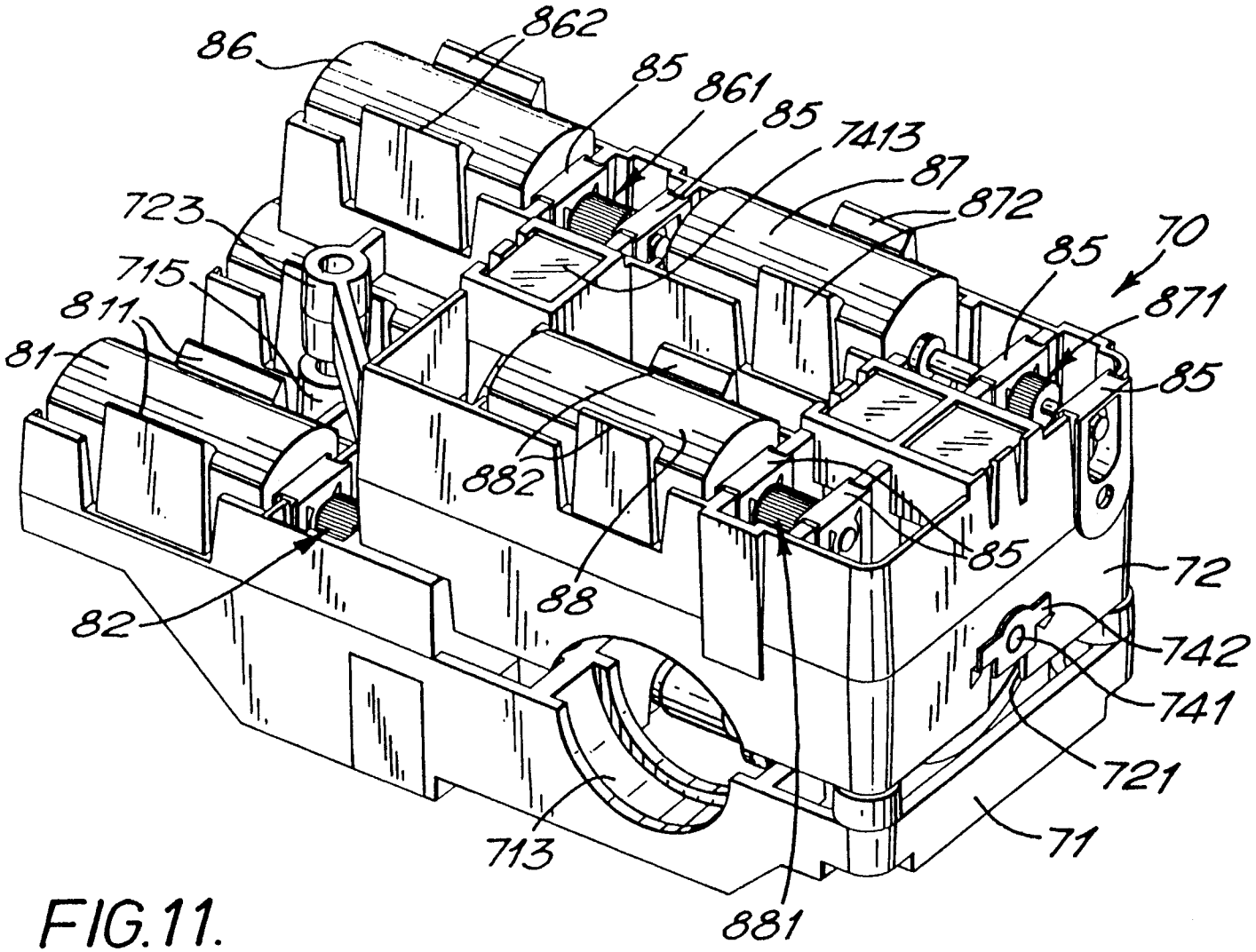
FIG. 11 is a perspective view of the gearbox assembly.
Figure 13:
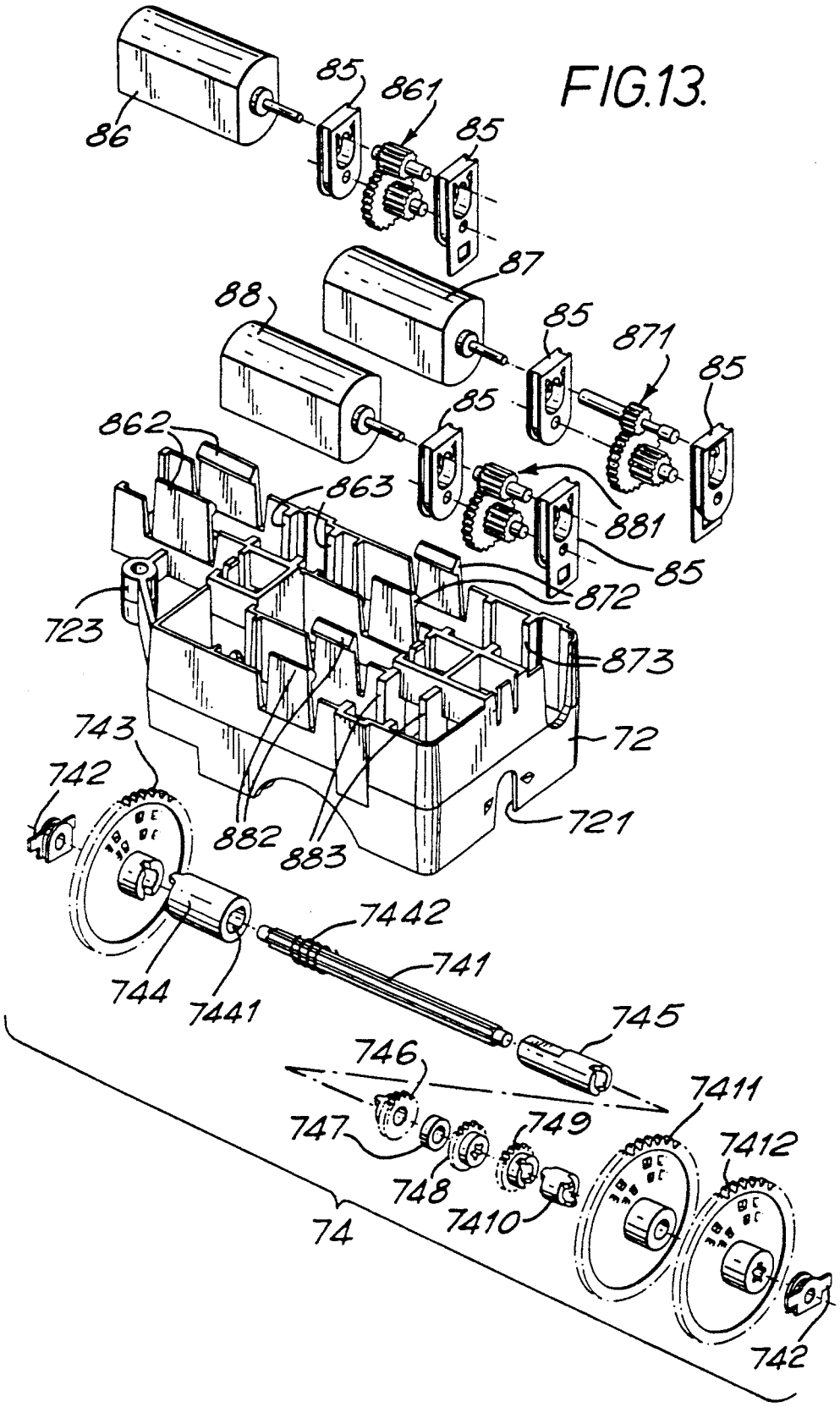
FIG. 13 is an exploded perspective view of the upper half of the gearbox assembly.
Figure 14:
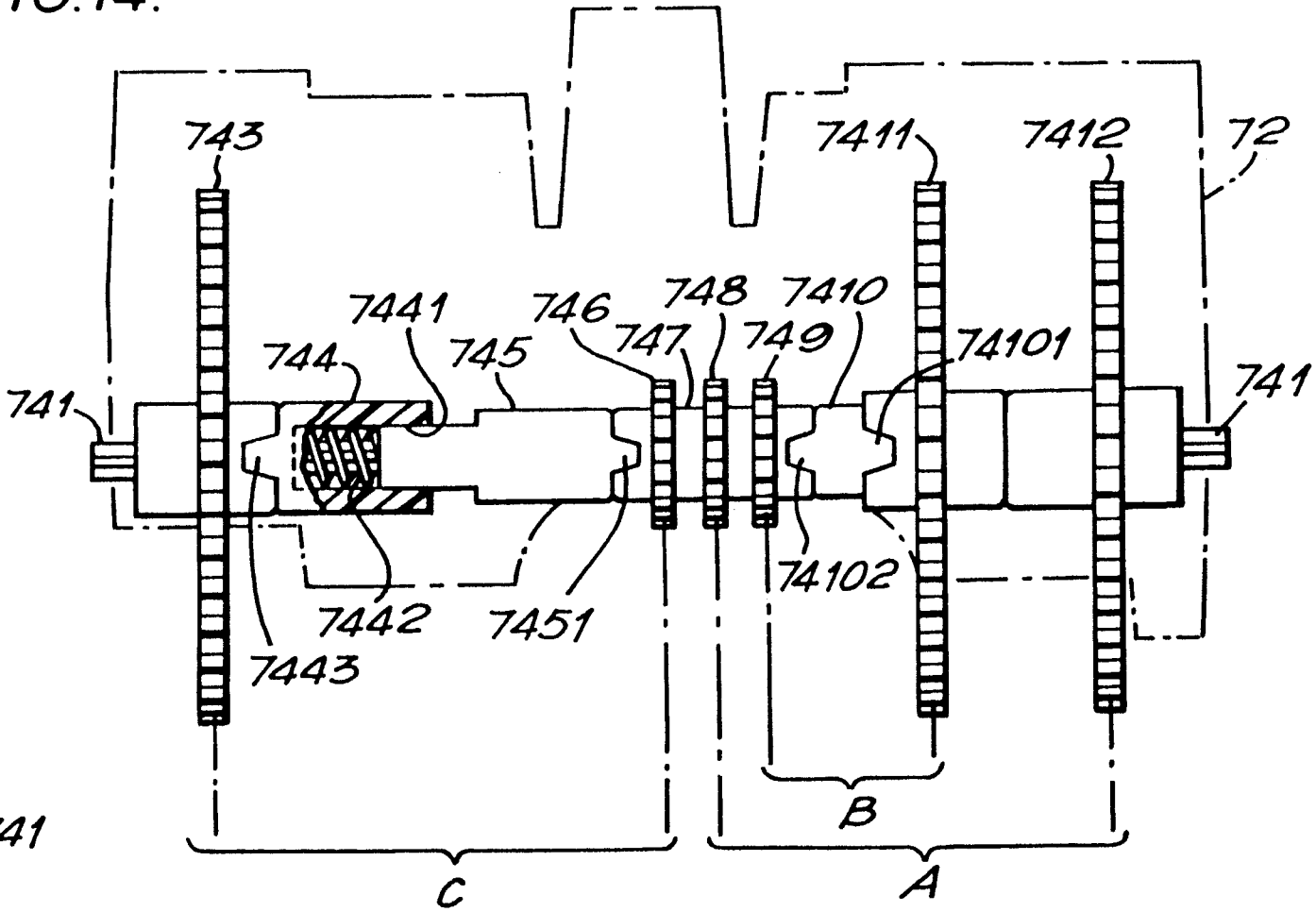
FIG. 14 is a diagrammatic side view of the upper rack drive assembly 74.
Figure 15:
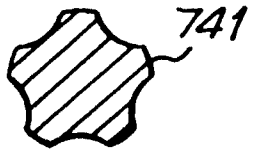
FIG. 15 is a cross-section through a splined drive shaft of the upper rack drive assembly 74.

Referring mainly to FIGS. 13 to 15, the upper rack drive assembly 74 will now be described. A splined drive shaft 741, having a generally pentagonal cross-section as shown in FIG. 15, extends the full length of the drive assembly and is rotatably supported at both ends by snap-in bearing clips 742. These bearing clips 742 snap into slots 721 at both ends of the lower half of the upper gearbox portion. FIG. 11 shows one of the bearing clips 742 snapped into place in its respective slot 721. Returning to FIG. 13, the splined drive shaft 741 supports, starting from the left-hand end of the drive assembly as viewed in FIG. 13, a first encoder gear 743, an outer half-shaft 744, an inner half-shaft 745, a first cross-over gear 746, a spacer 747, a second cross-over gear 748, a third cross-over gear 749, a spacer 7410, a second encoder gear 7411 and a third encoder gear 7412. The encoder gears 743, 7411, 7412 are each driven by a respective motor, as will be described later.

Each one of the cross-over gears 746, 748, 749 is drivingly engaged with one of the three upper racks 641 of the drum shaft 64 when the drum shaft is in its "home" position as shown in FIG. 10. Each cross-over gear must be independently rotatable in order to permit independent adjustment of the three racks 641. In order to achieve this, the third encoder gear 7412 and its associated cross-over gear 748 engage with the splined profile of the drive shaft 741 so that drive may be transmitted from the encoder gear 7412 to the cross-over gear 748 by means of the drive shaft 741 (drive path A in FIG. 14). The other components do not engage with the drive shaft 741 so that they are freely rotatable relative thereto. In this way, the encoder gear 7412 may drive its cross-over gear 748 without also at the same time causing rotation of the other components.

The second encoder gear 7411 is drivingly engaged with dogs 74101 of the neighbouring spacer 7410. The spacer 7410 is also engaged via dogs 74102 with the third cross-over gear 749. As mentioned above, all three components are freely rotatable around the splined drive shaft 741 and thus drive may be transmitted from the encoder gear 7411 to its associated cross-over gear 749 by means of the intervening spacer 7410. This provides a second drive path B which is independent of the first drive path A from the encoder disc 7412 to its cross-over gear 748.

The first encoder gear 743 is drivingly engaged with dogs 7443 of the outer half-shaft 744. An internal bore 7441 of the half-shaft 744 has a noncircular cross section so that it drivingly engages a correspondingly profiled outer section of the inner half-shaft 745 which is received in the bore 7441. In this way, rotational drive may be transmitted from the outer half-shaft 744 to the inner-half shaft 745. The inner-half shaft 745 is engaged via dogs 7451 with the associated first cross-over gear 746 so as to pass the drive thereonto. Thus, there is formed a third drive path C from the encoder disc 743 to the cross-over gear 746. All of the components 743, 744, 745 and 746 are freely rotatable about the splined drive shaft 741.

The encoder gears 743, 7411, 7412 are driven by motors 86, 88, 87 respectively (see FIG. 13).

It may be seen that there are three independent drive paths from the motors 86, 88, 87, through their associated encoder gears 743, 7411, 7412 and onto their respective cross-over gears 746, 749, 748.

It will be seen that this is a particularly compact and convenient solution to the problem of driving a plurality of racks from a corresponding plurality of motors.

When the ends of the splined drive shaft 741 are inserted into the bearing clips 742 and the clips 742 are snapped into their respective slots 721 in the walls of the upper gearbox portion 72, there is a need to ensure that the components mounted on the drive shaft 741 are accurately located along the length of the drive shaft so that the encoder gears are in their correct positions to be driven by the motors and the cross-over gears are in their correct positions to drive the racks 641. This is necessary because all of the components on the drive shaft 741 are slidable along the length of the shaft. The necessary correct positioning of the components is ensured by the provision of an axial biassing spring 7442 located within the bore 7441 of the outer half-shaft 744. The spring 7442 acts between the inner and outer half-shafts 744, 745 (see FIG. 14) in order to bias the two components apart.

The spring 7442 also ensures that the two encoder gears 743, 7412 at the ends of the string of components assembled on the drive shaft 741 are axially biassed against the adjacent bearing clips 742. Because the strength of the spring 7442 may be varied, this permits the frictional resistance of the rotational drive between each encoder gear and its associated cross-over gear to be pre-set. The spring 7442 also ensures that the components which are engaged with one another via dogs do not introduce any backlash into the drive between the encoder gears 743, 7411 and their associated cross-over gears 746, 749.

Because the spring 7442 ensures the accurate positioning of the components on the drive shaft 741, there is no build up of tolerance errors owing to the presence of many components and therefore a satisfactory overall tolerance may be achieved despite the use of many components. Consequently, ultra-high precision components are not required which leads to less expensive manufacture without loss of efficiency or performance. All of the components of the rack drive assembly 74, except for the cross-over gears, are made out of plastics material. The cross-over gears are made of metal in order to resist wear caused by driving the three uppermost racks 641.

Figure 12:
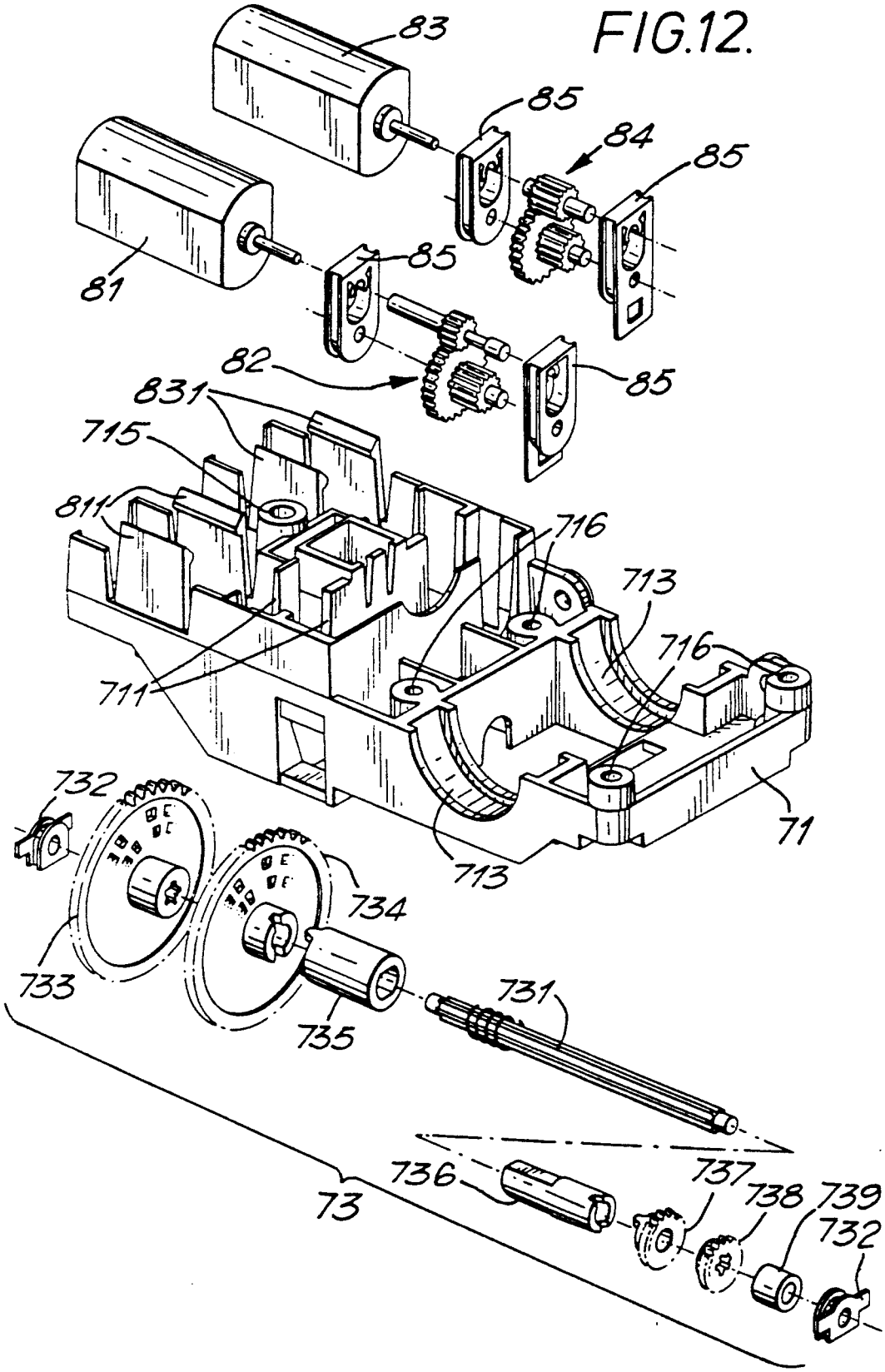
FIG. 12 is an exploded perspective view of the lower half of the gearbox assembly.
Figure 16:
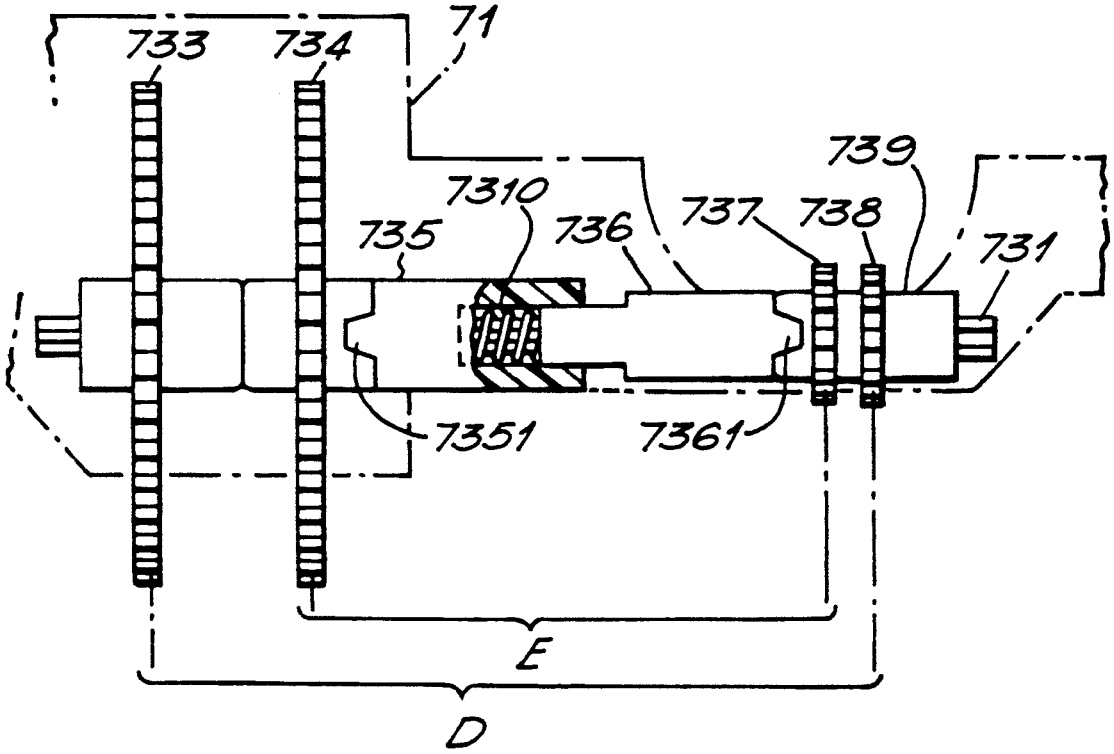
FIG. 16 is a diagrammatic side view of the lower rack drive assembly 73.

The construction of the lower rack drive assembly 73 shown in FIGS. 10, 12 and 16 is analogous to that of the upper rack drive assembly 74 just described. The major difference is that the lower rack drive assembly 73, because it only has to drive the two lower racks 641, only has two encoder gears and two cross-over gears. The lower rack drive assembly 73 has a splined drive shaft 731 that is rotatably mounted at both ends in snap-in bearing clips 732. The clips 732 snap into slots (not shown) in the walls of the lower gearbox portion 71. One of the bearing clips 732 when snapped into place is visible in FIG. 10. Starting from the left-hand end of the lower rack drive assembly 73 as shown in FIG. 12, the following components are mounted on the splined drive shaft 731: a first encoder gear 733, a second encoder gear 734, an outer half-shaft 735, an inner-half shaft 736, a first cross-over gear 737, a second cross-over gear 738 and a spacer 739. An axial biassing spring 7310 is also provided. The encoder gears 733, 734 are driven by motors 81, 83 respectively. The encoder gear 733 and cross-over gear 738 have profiles that complement the generally pentagonal profile of the splined drive shaft 731. In this way, drive may be transmitted from the encoder gear 733 via the drive shaft 731 to the cross-over gear 738. The remaining components are rotatably mounted on the drive shaft 731. Thus, there is formed a first drive path D from the encoder disc 733 to its associated cross-over gear 738. A second, independent drive path E is formed by the second encoder gear 734, the outer and inner half-shafts 735 and 736 and the first cross-over gear 737. These components are freely rotatable around the drive shaft 731 and are linked together via dogs 7351 and 7361, with spring biassing, in a manner analogous to that of components 743 to 746 of the upper rack drive assembly 74, described above.

The lower rack drive assembly 73 therefore includes two drive paths, from the motors 81, 83, through the encoder discs 733, 734 and onto the cross-over gears 738, 737 respectively. Each of the two cross-over gears 737, 738 independently drives a respective one of the pair of racks 641 in the lower half of the drum shaft 64 when the drum shaft is in its "home" position as shown in FIG. 10.

ENCODER GEAR

Figure 17:
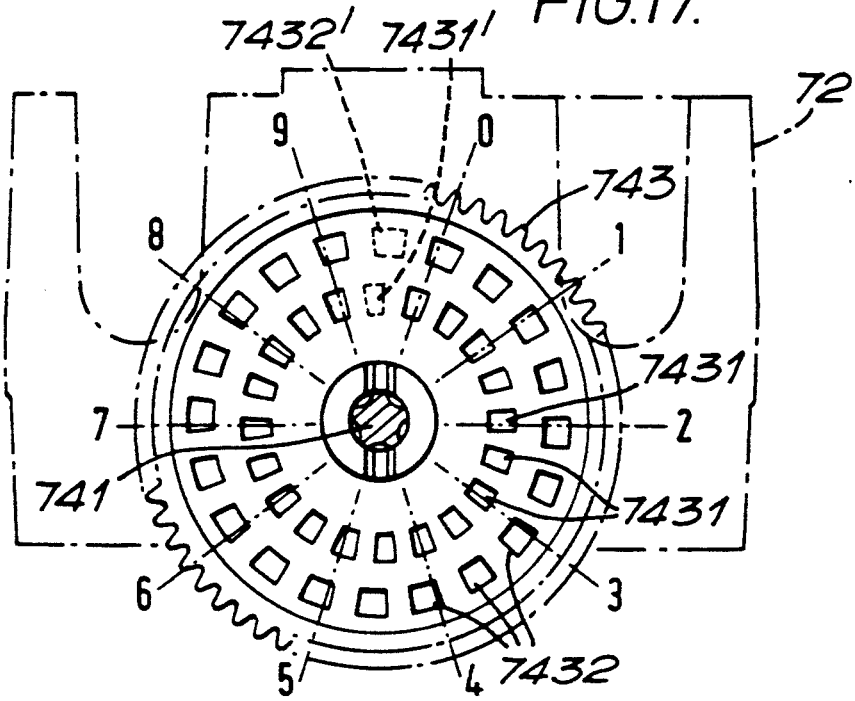
FIG. 17 illustrates, as a cross-sectional representation, one of the encoder gears.

FIG. 17 shows how each encoder gear 743, 7411, 7412 of the upper rack drive assembly 74 and each encoder gear 733, 734 of the lower rack drive assembly 73 contains apertures which permit the rotational position of the encoder gear to be determined. The arrangement shown in FIG. 17 is a cross-section representative of the arrangement relating to the encoder gear 743 or the encoder gear 7411 of the upper rack drive assembly 74. The arrangement in relation to the encoder gear 743 is described. The arrangements for the other four encoder gears are analogous.

In use, a dual channel interrupted light beam sensor 7413 (see FIG. 11) is positioned in an aperture directly above the encoder gear 743. The encoder gear 743 has an inner annular array of apertures 7431 and an outer annular array of apertures 7432. The sensor located in the aperture straddles the encoder gear 743 so as to have a first light beam at the radial distance corresponding to the inner apertures 7431 and a second light beam positioned at the radial distance corresponding to the outer apertures 7432. A detector is provided for each light beam so as to detect when it is and when it is not interrupted by the solid portions between the apertures associated with that light beam. The information from the two detectors is fed to the main logic board 24. By knowing the position of the encoder gear 743, the position of the digit wheel 631 driven via the cross-over gear 746 and associated rack 641 is also known. The encoder gear serves the two purposes of acting as a drive gear, as will be described in more detail later, and giving information regarding the position of the associated digit wheel 631.

Because of the limited longitudinal movement of the rack 641 associated with the encoder gear 743, the encoder gear only ever rotates less than a single revolution. Around the circumference of the encoder gear 743 in FIG. 17 are illustrated the positions associated with the digits 0 to 9 of the associated digit wheel 631. When the encoder gear 743 is rotated so that the notional line associated with the indicated value 0 is pointing vertically upwards as viewed in FIG. 17, then the associated digit wheel 631 will present the numeral 0 as its contribution to the postage value to be printed. Likewise, when the notional radial line numbered 1 is pointing vertically upwards, the digit wheel 631 will present the numeral 1 for printing. Similarly, by rotating the encoder gear so that the notional lines numbered 2 to 9 point vertically upwards, the digit wheel 631 may be rotated to present the numerals 2 to 9 for printing.

Each encoder gear is driven by its own motor. It is important that the rotational position of the encoder gear is accurately known so that, by means of feedback, the motor may be used to accurately position the encoder gear at the correct rotational position associated with the numeral value desired to be presented on the digit wheel 631 for printing. The apertures 7431 and 7432 enable this to be done. Assuming 1 to equate to no light being received by a detector, and 0 to equate to light being received by the detector, then the apertures 7431 and 7432 modulate the two light beams to produce a binary output from each of the two light detectors positioned to detect whether or not light is passing through the apertures 7431 and 7432. The two binary outputs combine to produce a quadrature-type output.

The two sets of apertures are arranged so that, as the encoder gear 743 rotates, the outputs of the two channels of the two detectors cycle in the following manner as the gear rotates through the 36° associated with moving the digit wheel 631 from one numeral value position (e.g. 2) to an adjacent numeral value position (e.g. 3): 00,01,11,10,00,01,11,10,00. Each pair of outputs is in the following order: output from outer detector and then output from inner detector. Thus, the apertures 7431, 7432 make it possible to resolve eight different positions as the encoder gear 743 rotates through 36°. The encoder gear 743 therefore has a resolution of $4\frac{1}{2}$°. This gives and accuracy of $\pm 2\frac{1}{4}$° about a desired position.

Previously, encoder discs in postage meters have had the apertures 7431, 7432 positioned at twice the circumferential pitch, thereby giving a resolution of 9° (i.e. $4\frac{1}{2}$° either side of a desired position).

With a resolution of $4\frac{1}{2}$° or 9°, the quadrature output at each position associated with a numeral is 00. When doubling the resolution from 9° to $4\frac{1}{2}$°, an output of 00 is also produced at the mid-points between the positions associated with the numeral values. Thus, the system must know which of the outputs of 00 correspond to the numeral values and which correspond to the mid-points between the numeral values. This is determined during an initialisation routine when the equipment is first activated ("hard" initialisation).

Because of the limited longitudinal movement of the rack 641 driven by the encoder gear 743, the encoder gear is only able to move from the 0 position to the 9 position by rotating through the intermediate values 1 to 8. It is not able to move directly from 0 to 9. If the gear tries to rotate from 0 to 9, some movement will be possible but the rack 641 will then hit one of its end stops and no further movement will be possible. Likewise, should movement be attempted from 9 to 0, the rack 641 will hit the other one of its end stops after a small degree of movement and then no further rotation will be possible. Once an end stop has been reached, the encoder gear is rotated in the opposite direction and the detector is used to detect the first 00 quadrature output. The logic circuitry assumes that this first 00 quadrature output corresponds to the 0 or 9 position. In the case of an encoder gear offering 9° resolution this assumption will always be correct. For example, if the gear is rotating from 3 to 2 to 1 to 0 in order to find the end stop of the rack, there will be a 00 quadrature output at the 0 position and no further 00 quadrature output because the next such output is at the 9 position and that position cannot be reached from the 0 position. Thus, once the rack reaches its end stop and the encoder gear reversed direction, the first 00 quadrature output to be reached will be the one associated with the 0 position. Because the encoder gear offering 9° resolution only has ten 00 quadrature outputs, moving the rack 641 from end stop to end stop enables the 00 quadrature outputs associated with the 0 and 9 positions to be determined without any possibility of error.

However, with the arrangement shown in FIG. 17 where a 4½° resolution is offered, the occurrence of a 00 quadrature output between the 00 quadrature outputs of the 0 to 9 positions could cause problems. For example, manufacturing variations may be such that, during hard initialisation, the encoder gear is moved through its 1 position to its 0 position and then sufficiently far past its 0 position that the 00 mid-point position between the 0 and 9 positions can be reached. When the encoder gear reverses direction, the system will mistake the mid-point 00 quadrature output as the 00 output of the 0 position and thereafter operate so as to position the digit wheel 631 half a digit offset from the intended value desired to be presented for printing. For example, the digit wheel 631 would present for printing the blank space between the 8 numeral and the 9 numeral when in actual fact it is the 9 numeral that is intended to be printed.

In order to prevent this from happening, the encoder gear 743 has two of its apertures 7431, 7432 blanked out between the notional lines associated with the 0 and 9 positions. Specifically, there is a blanked out one 7431' of the apertures 7431 and a blanked out one 7432' of the apertures 7432. The apertures chosen to be blanked out are those which thereby prevent the generation of a 00 quadrature output at any point between the 0 and 9 positions of the encoder gear 743. If the encoder gear were to be able to move fully between its 0 and 9 positions, the quadrature output would vary as follows: 00,10,11,11,11,11,11,01,00. By removing the 00 quadrature output that would otherwise be generated between the 0 and 9 positions, it does not matter if the manufacturing variations are such that, when the rack 641 is moved between its end stops during the hard initialisation routine, one of the end stop positions involves the gear 743 rotating through the mid-point between the 0 and 9 positions. The first 00 quadrature outputs to be generated upon moving away from the two end stops will be those associated with the 0 and 9 positions and thus the system will accurately be able to determine the position of the digit wheel 631 from the measured position of the encoder gear 743.

If the apertures 7431' and 7432' were not blanked in (filled in), then the tolerances of the whole assembly would have to be such that there was no possibility, during hard initialisation, of movement between the end stops of the rack 641 causing the production of a 00 quadrature output at the mid-point between the 0 and 9 positions. Because the arrangement shown in FIG. 17 prevents a 00 quadrature output being produced at the mid-point, the tolerances of the whole assembly may be relaxed and be kept substantially the same as those associated with an encoder gear offering a 9° resolution instead of the 4½° resolution as shown in FIG. 17. Thus, the FIG. 17 arrangement offers the improvement in resolution to 4½° without the normally associated requirement to double the accuracy of the tolerances associated with manufacturing the whole assembly.

The exact sequence of events during hard initialisation, upon first power up, is now described. The encoder gear 743 is driven by its motor until it hits the end stop adjacent to the 9 position. The gear is then rotated in the opposite direction. The 00 quadrature outputs are detected as they occur and eventually the gear hits the end stop adjacent to the 0 position. The gear is moved back to the first 00 quadrature output and the main logic board 24 treats this as the 0 position. The gear carries on rotating up to the 9 position and then rotates back down to the 0 position. This enables the main logic board to check that there are the required ten positions associated with the 00 quadrature outputs.

Suppose the gear 743 is at the 7 position when the postage meter is turned off. This fact is stored in the main logic board 24. When the postage meter is turned back on, a "soft" initialisation is performed in order to confirm that the gear 743 was still at the 7 position when the meter was turned back on. The "soft" initialisation involves the gear motor rotating the gear up to the 9 position and then back down to the 0 position, with the extent of movement in both directions being based on the assumption that the gear had indeed remained at the 7 position all the time the postage meter was turned off. If the movement between the 0 and 9 positions is completed without hitting either end stop, then the main logic board 24 knows that it was correct to assume that the gear had remained at the 7 position during power down.

The soft initialisation is performed every time from the second power up onwards. The first power up triggers a hard initialisation.

If either type of initialisation fails to complete successfully, the main logic board 24 initiates up to two further attempts.

As explained previously, the dual channel sensor 7413 used to produce the quadrature output uses two light beams. Each beam is generated by a light emitting diode (LED) and detected by a photodiode. It has been found that the edges of the apertures 7431, 7432 in the encoder gear 743 diffract any light beam that grazes past them. For each photodiode, this tends to make it more difficult to detect the transition between the light beam (i) passing through an aperture and (ii) being interrupted by the solid portions between the apertures. The diffraction phenomenon has a blurring effect, because, even when the line of sight between the LED and the photodiode is blocked by an inter-aperture solid portion, light is able to set off at an angle to the line of sight from the LED and be bent by the diffraction effect at the edge of the aperture so that it falls on the photodiode. In other words, the light follows a zigzag path.

In the present postage meter the diffraction blurring is prevented by placing slots in front of each LED and its associated photodiode. The slots ensure that only light that has travelled along the straight line from the LED to the photodiode will be able to impinge on the photodiode.

SNAP-IN BEARING RETAINING CLIPS

Employment of snap-in bearing retaining clips allows particularly convenient and easy assembly of the gearbox parts during the assembly stage of manufacture:

Because the lower and upper gearbox portions 71, 72 are made out of plastics material, there is the conflicting requirement of choosing a material which is easy to mould and gives good dimensional accuracy and which also is capable of acting as a bearing for a rotating shaft. In order to prevent an unsatisfactory compromise regarding the material for the gearbox portions 71, 72, the parts of the gearbox assembly 70 which have to act as bearings for rotating shafts are produced as separate inserts which are clipped into place in the walls of the upper and lower gearbox portions 71, 72. Thus the upper and lower gearbox portions, which are formed generally as compartmental housings, may be made out of 30% glass filled plastics material. This material is not suitable for the snap-in bearing clips shown in FIGS. 18 and 19 because, once the surface layer of resin has been abraded away, the glass fibre reinforcement becomes exposed and abrades the rotating shaft. Thus, the bearing clips of FIGS. 18 and 19 are made of a suitable known low friction material.

Each encoder gear is driven by a respective motor and reduction gear assembly.

In respect of the lower gearbox portion 71 (see FIGS. 10 and 12) the motor 81 drives the encoder gear 733 through a reduction gear assembly 82. The motor 83 drives the encoder gear 734 through a reduction gear assembly 84.

The two motors 81, 83 are held in place by pairs of clips 811 and 831. The individual gears of each reduction gear assembly 82, 84 are rotatably mounted in pairs of bearing clips 85.

A representative clip of this type is diagrammatically illustrated in FIG. 18. Each bearing clip 85 has two circular apertures 851 for receiving the shafts of the associated reduction gear assembly. The side edges of the clip 85 contain channels 852 which guide the clip 85 when it is slid into a slot 711 formed in the lower gearbox portion 71. At the bottom of the clip 85 is a flange 853 which contains an aperture 854. As the clip 85 reaches the bottom of the slot 711, the flange 853 rides up a ramp 712 provided adjacent to the bottom of the slot 711. Eventually, a web 8531 of the flange 853 snaps down round the back of the ramp 712 so as to prevent withdrawal of the clip 85 from the slot 711.

Viewing the arrangement shown in FIG. 12, it may be seen that the motor 81, for example, may be assembled with its associated clips 85 and reduction gear assembly 82 and then slotted down into the lower gearbox portion 71 to be retained in place by the clips 811 and by the clips 85 engaging with the associated slots 711 and their ramps 712. The resulting positioning of the motor 81, clips 85 and reduction gear assembly 82 is as shown in FIG. 10.

As explained previously, the splined drive shafts 731, 741 of the rack drive assembly 73, 74 are rotatably mounted in bearing clips 732, 742. These clips are clipped into slots (e.g. slot 721 in FIG. 11) in the gearbox portions 71, 72. A representative clip of this type is diagrammatically illustrated in FIG. 19.

Referring to that Figure, the bearing clip 742 has an aperture 7421 within which is rotably mounted the drive shaft 741. The clip 742 also has a pair of wings 7422 which flex up and over ramps 722 as the clip 742 is inserted into the slot 721. FIG. 19 shows only half of the clip 742. The entire clip is shown in FIG. 11.

The clips 85 are designed so that their channels 852 form a loose fit with the walls of the slot 711. In this way, the reduction gear assembly is able to move slightly so as to prevent binding up between itself and the associated encoder gear.

A suitable material for the snap-in clips is a combination of nylon and PTFE.

Referring to FIGS. 11 and 13, the upper gearbox portion 72 contains the motors 86, 87, 88 and respective reduction gear assemblies 861, 871, 881. As was the case in relation to the lower gearbox portion, the motors and reduction gear assemblies of the upper gearbox portion are preassembled with snap-in bearing clips 85 and then slid down into the compartmental casing of the upper gearbox portion. The motors 86, 87, 88 are held in place by respective pairs of clips 862, 872, 882. The clips 85 are slotted down into respective pairs of slots 863, 873, 883 in a manner analogous to that described in relation to the lower gearbox portion. The ramps positioned at the bottom of the slots 863, 873, 883 for holding in position the clips 85 are not visible in FIGS. 11 and 13. However, they are provided and have a construction similar to that of ramp 712 illustrated in FIG. 18.

The motors 86, 87, 88 drive the encoder gears 743, 7412, 7411 respectively. The purpose of the motors is to adjust the positions of the racks and hence alter the positions of the digit wheels in the print drum to the selected postage value set by the user pressing the buttons 131.

MOUNTING OF GEARBOX ASSEMBLY ON DRUM SHAFT

Once the components of the lower gearbox portion 71 have been assembled, the lower gearbox portion is assembled with the print drum assembly 60. The lower gearbox portion 71 has a pair of arcuate recesses 713 for receiving plain bearings 66 which permit rotation of the drum shaft 64 and print drum 63. The front bearing 62 is also provided and, as will be described later, this bearing is eventually seated in the bearing support surface 44 of the wall 42 of the base unit 40.

When the print drum 63 is rotated from the "home" position shown in FIG. 10 so as to complete a whole revolution, the drum shaft 64 and hence the racks 641 also rotate. In order to prevent the cross-over gears which engage the racks when the print drum 63 is at its "home" position from catching on the drum shaft 64 as it rotates, a number of circumferential grooves 67 are provided. These grooves 67 also prevent unwanted rotation of the cross-over gears as the print drum rotates, thereby preventing a loss of registration between the encoder gears and their associated digit wheels 631 in the print drum 63.

The drum shaft 64 has a further groove (not visible in the drawings) similar to the grooves 67 but located between the front bearing 62 (see FIG. 10) and the adjacent plain bearing 66. A pair of rack lock plates 68 extend into this extra groove when the print drum 63 is at its "home" position. The rack lock plates 68 are arranged so that they do not interfere with the longitudinal movement of the racks 641 when the print drum 63 is at its "home" position. However, as soon as the print drum starts to rotate, the racks 641 are rotated into locking engagement with the rack lock plates 68. In this way, unwanted longitudinal movement of the racks 641 is prevented during each rotational cycle of the print drum 63. The rack lock plates 68 also serve the function of longitudinally restraining the entire print drum shaft 64. Screws 714 are screwed through a side wall of the housing of the lower gearbox portion 71, through the rack lock plates 68 and into the front bearing 62.

Once the state of assembly shown in FIG. 10 has been achieved, the upper gearbox portion 72 is screwed and/or clipped onto the lower gearbox portion to result in the gearbox assembly 70 as illustrated in FIG. 11 being disposed around the drum shaft 64 of the print drum assembly 60.

The lower and upper gearbox portions 71, 72 have respective bosses 715, 723 used to screw the two gearbox portions together. For the same purpose, the lower gearbox portion 71 is provided with four screw holes 716 (see FIG. 12).

FIG. 20 is a diagrammatic illustration of how the gearbox assembly 70 is supported on the base plate 41. FIG. 20 also shows how the gearbox assembly 70 is assembled around the drum shaft 64 of the print drum assembly 60. Essentially, the two gearbox portions 71, 72 are clamped around the drum shaft 64 and screwed together.

In prior art postage meters, the print drum assembly 60 would be mounted on the base unit 40 and the gearbox assembly 70 would be separately mounted on the base unit 40. Because of this, tolerances had to be carefully controlled in order to ensure that the relative positioning of the print drum assembly 60 and gearbox assembly 70 was satisfactory. The tolerances between the gearbox assembly 70 and print drum assembly 60 have to be carefully controlled in order to prevent inaccurate engagement of the cross-over gears of the gearbox assembly with the racks of the print drum assembly.

The arrangement shown in the accompanying figures has the gearbox assembly 70 mounted directly on the print drum assembly 60. In other words, the upper gearbox housing 72 and the lower gearbox housing surround and are supported by the drum shaft 64. This makes it easier to ensure that the cross-over gears of the gearbox assembly 70 engage accurately with the racks 641 of the print drum assembly 60. The two assemblies 60, 70 form a single unit which is mounted as one on the base unit 40. This is done by positioning the front main bearing 62 in the bearing support surface 44 of the base unit 40. The front bearing 62 has a pair of screw holes 621 so that it may be screwed onto the underlying base wall 42. The other end of the drum shaft 64 carries the rear bearing 61 and this sits in the bearing support surface 43. The gearbox assembly 70 is not directly mounted on the base unit 40. It is only indirectly mounted on the base unit 40 via the print drum assembly 60.

In order to prevent vibration of the gearbox assembly 70, a pad 75 of resilient material is placed between the end of the lower gearbox portion 71 remote from the drum shaft 64 and a boss 53 of the base unit 40. However, this pad 75 does not serve to determine the positioning of the gearbox assembly. As explained above, it is one of the important and advantageous features of the present invention that the position of the gear box assembly 70 relative to the base unit 40 is determined by the positioning of the gearbox assembly 70 on the print drum assembly 60. This has the consequence that positioning the drum shaft assembly 60 on the saddles 43, 44 (FIG. 6) automatically results in the proper positioning of the gearbox relative to the base unit 40, as well as properly positioning the cross-over gears relative to the racks.

LIMITED BACKLASH CLUTCH

Figure 21:
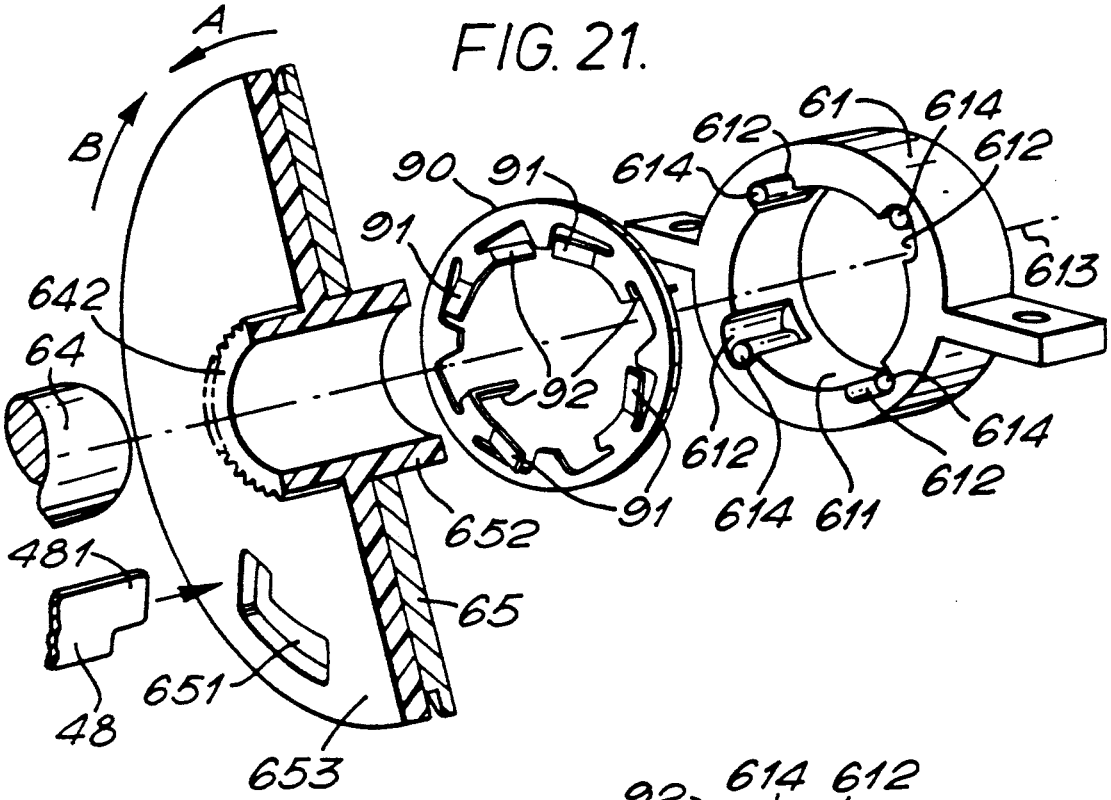
FIG. 21 is an exploded perspective view of a limited backlash clutch incorporated in the rear bearing used to support the rear end of the drum shaft.

The limited backlash clutch is located partly within the rear bearing 61. The rear bearing 61 has a circular bore 611 which rotatably supports the drum shaft 64. Also shown in FIG. 21 is the drive gear 65, which is supported on a hub 652 of a disc-like cam 653. The slot 651, by means of which the shutter bar 48 is able to lock the print drum assembly 60 in its "home" position, extends through both the disc-like cam 653 and the drive gear 65. The drive gear 65/disc-like cam 653 is non-rotatably mounted on the drum shaft 64 in order to permit this locking of the print drum assembly 60 in its "home" position. The hub 652 also carries the toothed portion 642 described previously in relation to FIG. 5. When the print drum assembly completes a cycle comprising a single revolution, the print drum assembly 60 must be brought to a halt at a position at which the shutter bar 48 may move into the slot 651 so as to provide the locking action. As has been explained previously, the postage meter base 2 contains a drive mechanism which drives the drive gear 65 to effect the rotation of the print drum assembly 60. Even when the drive mechanism of the postage meter base 2 is switched off at or slightly before the completion of a single revolution of the print drum 63, the inertia of the whole arrangement is such that some overshoot of the print drum assembly 60 and hence of the print drum shaft 64 past the "home" position may occur. There is therefore a need for a limited amount of backlash so as to permit the print drum assembly 60 to reverse a small extent so that the shutter bar 48 may slide into the slot 651 in order to lock the print drum assembly in its home position.

The print drum assembly 60 must be prevented from freely rotating in the reverse direction in order to prevent fraudulent interference with the postage meter.

In the bore 611 of the rear bearing 61 are provided four recesses 612. Each recess 612 runs a small distance in the circumferencial direction but, as it does so, the radial distance of its circumferential wall from the central axis 613 of the rear bearing 61 gradually decreases. This is most readily apparent in FIGS. 22, **22*a* and 22*b*. A roller 614 is provided in each recess 612**.

A clutch plate 90 is disposed between the rear bearing 61 and the drive gear 65. This clutch plate has four generally circumferentially extending tabs 91 and four drive tabs 92 that extend generally perpendicularly to the plane of the rest of the clutch plate. The circumferential tabs 91 all point in the forward direction of rotation of the print drum assembly 60. Each one of the drive tabs 92 extends into a respective one of the recesses 612, behind the associated roller 614. As may be seen from FIGS. 22, **22*a* and 22*b*, each drive tab 92 is located in the deeper part of its recess 612**.

When the print drum assembly 60 is rotating in its normal, forward direction (arrow A in FIG. 21), the drive gear 65 merely slides over the circumferential tabs 91 of the clutch plate 90 with comparatively little friction. The clutch plate rotates anti-clockwise as viewed in FIG. 21 until further rotation is prevented by the drive tabs 92 coming into contact with the deeper end walls of the recesses 612 (see FIG. 22).

Assuming that the print drum assembly 60 has completed a single revolution, but has overshot slightly its "home" position, then a limited amount of rotation in the reverse direction is permitted. As the limited amount of reverse rotation occurs, the free ends of the circumferential tabs 91 dig into the drive gear 65. This causes the clutch plate 90 to rotate with the drive gear 65 in the reverse direction (arrow B in FIG. 21). As the clutch plate 90 rotates it forces each roller 614 to move up from the deep part of its recess 612 to the shallow part. The result of this is that the rollers 614 are now projecting into the bore 611. The rollers 614 therefore bind with the drum shaft 64 to prevent any further rotation of the drum shaft. FIGS. 22, 22*a* and 22*b* illustrate in sequence what happens during the limited reverse rotation.

When the rollers 614 have locked up the drum shaft 64 (i.e. as in FIG. 22*b*), the drive tabs 92 also serve to hold in place the rollers 614 to prevent them from being shaken loose by somebody trying to interfere with the postage meter.

MULTI-SLOGAN CHANGE APPARATUS

Figure 5:
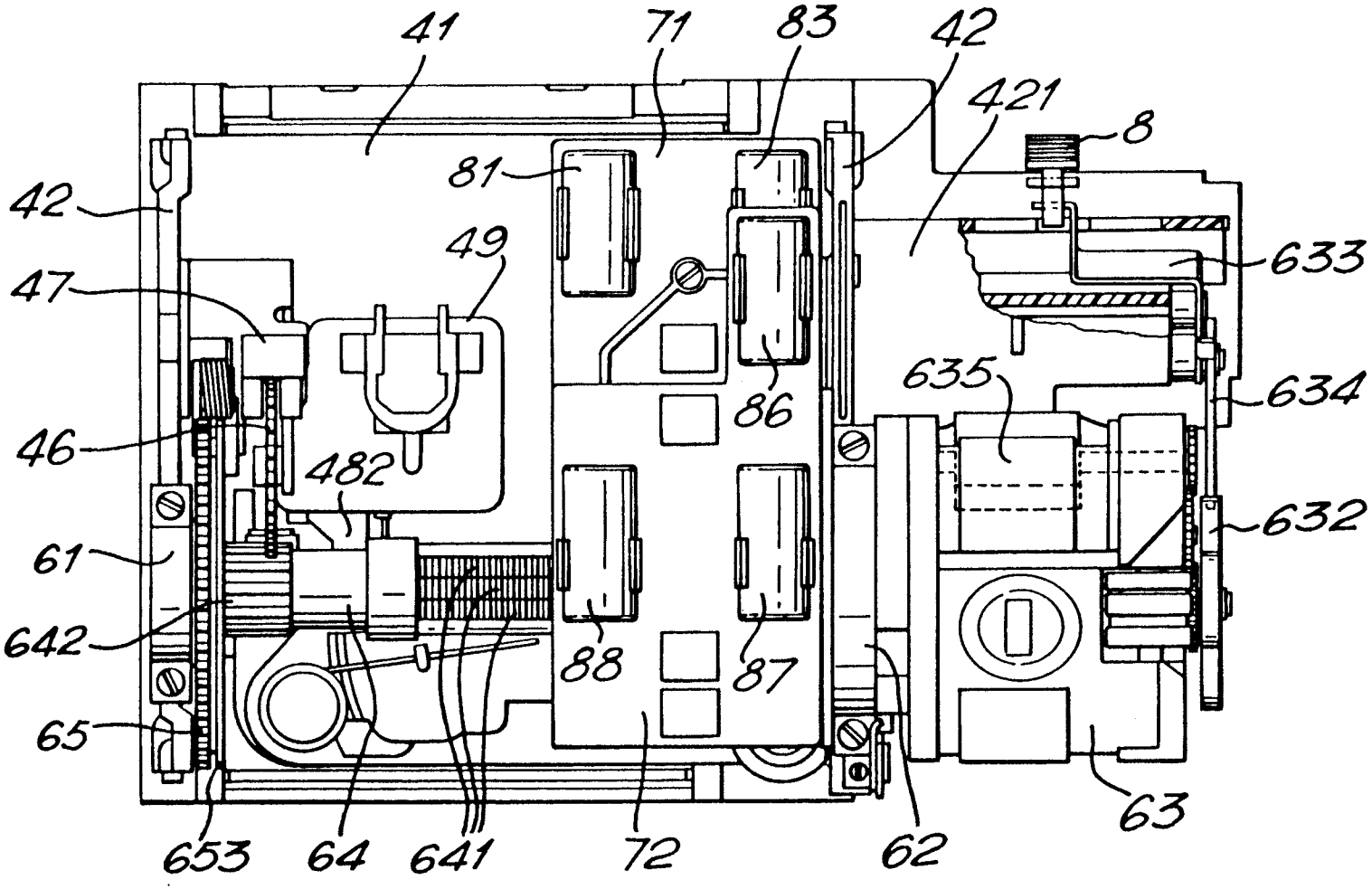
FIG. 5 is a plan view of the lower internal unit, which contains the main mechanical components of the postage meter.
Figure 6:
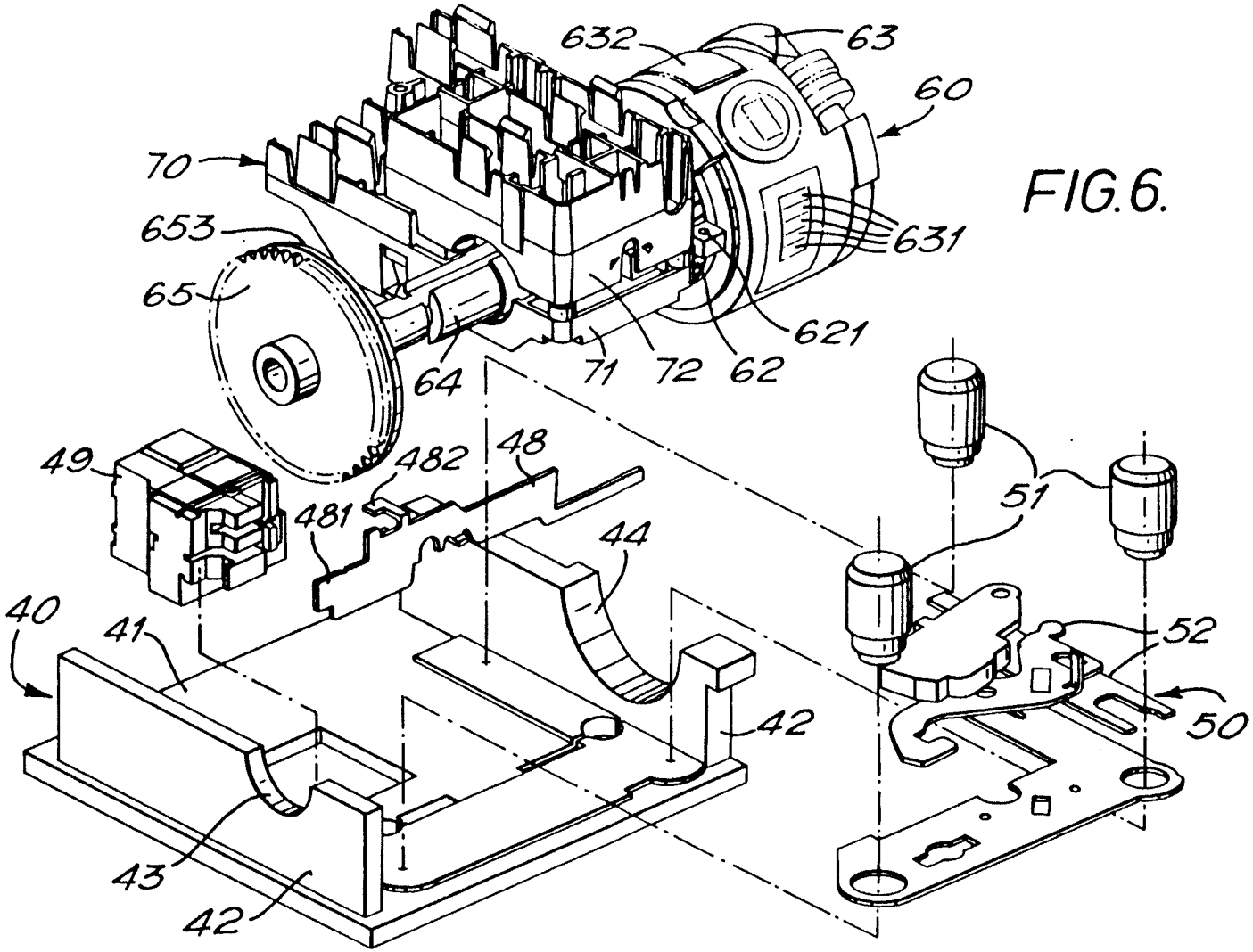
FIG. 6 is an exploded perspective view showing in diagrammatic form a number of the components of the lower internal unit (some of the components are omitted for the sake of clarity)
Figure 7:
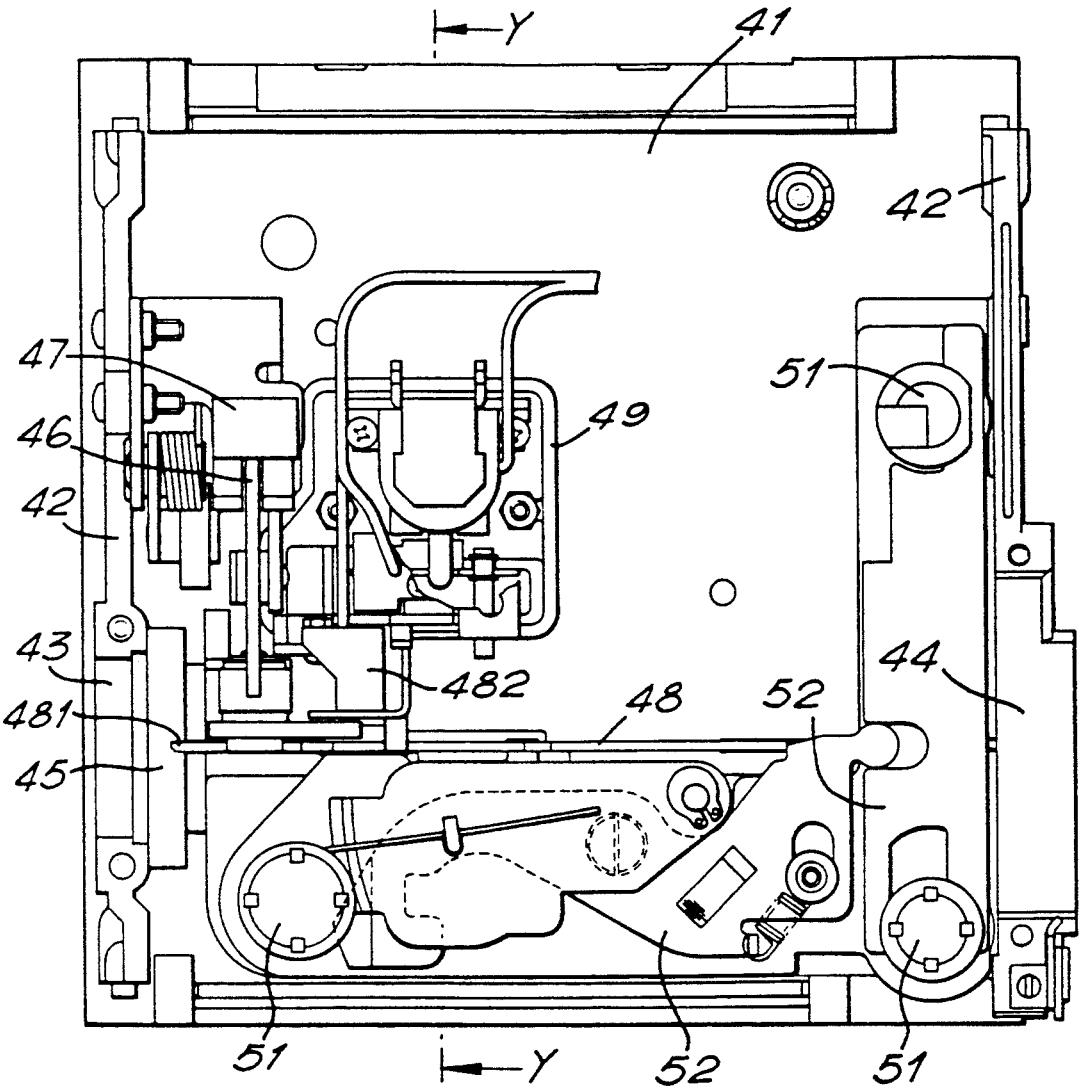
FIGS. 7, 8 and 9 are a plan view, a sectional view along the line Y—Y of the plan view and a side view respectively of some of the components forming the bottom portion of the lower internal unit.
Figure 9:
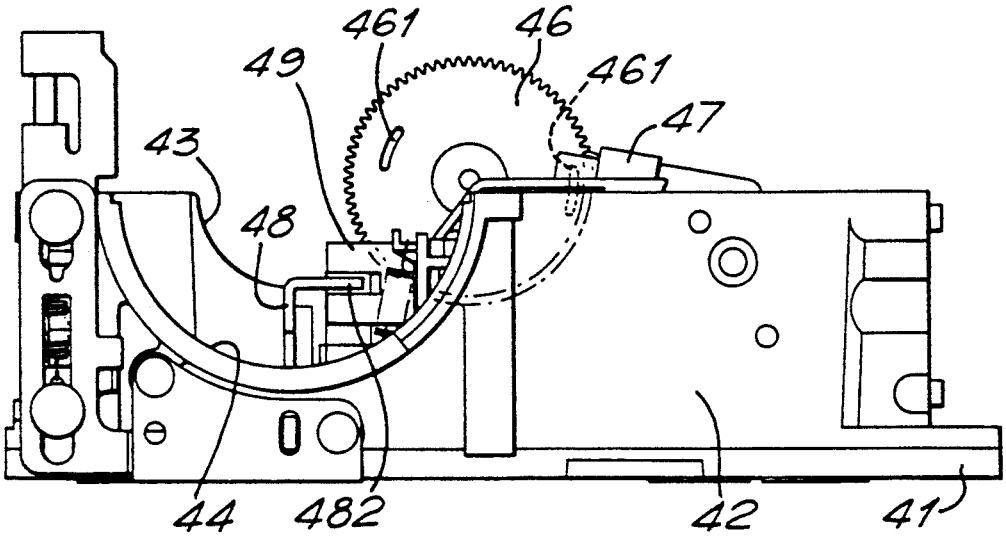
Figure 8:
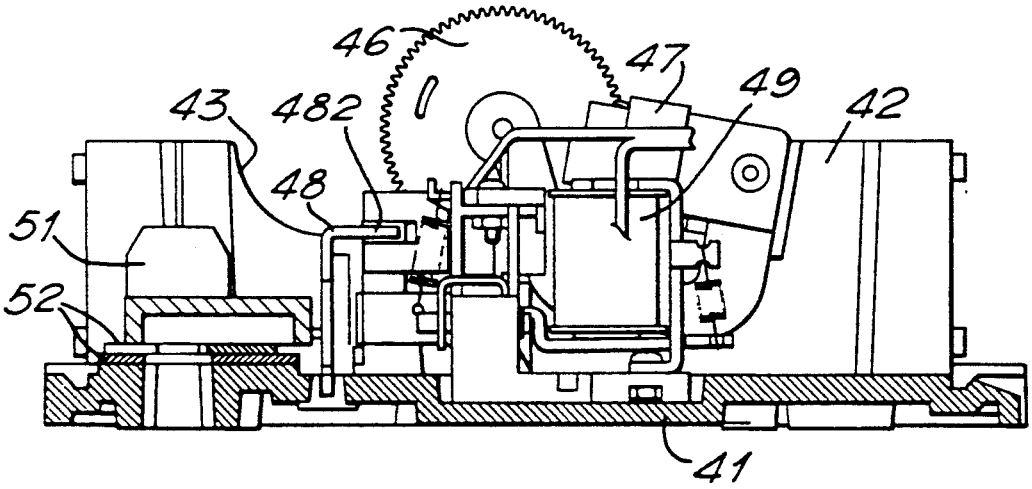

In addition to carrying the digit wheels 631 for printing postage value, the print drum 63 also carries a rotatable device 635 for printing a selectable one of a number of slogans on the mailpiece being franked (see FIG. 5). A Maltese Cross 632 is provided on the print drum 63 in order to rotate the multiple slogan device 635. In the prior art, the Maltese Cross 632 has been rotated either by means of physically being directly rotated or by means of some extension knob directly mounted thereon. The Maltese Cross 632 if turned directly would require the lifting up of a drum cover, such as drum cover 4 shown in FIG. 1, in order to achieve access thereto. If a knob is provided on the Maltese Cross 632, it could in the prior art arrangements project out of the housing so as to dispense with the need of having to move the drum cover. The disadvantage of having such a knob is that it is a moving part on the exterior of the housing and rotates every time the print drum assembly 60 is rotated when a mailpiece is franked.

With the arrangement shown in FIGS. 23 and 23*a*, a mechanism is provided which can be activated from outside the housing of the postage meter but which does not rotate or otherwise move when the print drum assembly 60 is activated to frank the mailpiece. A lever 633 is pivotably mounted on the base unit 40 by means of an adaptor 421 so as to be pivotable about a pivot 6331. The lever 633 is pivoted through a limited rotational range by means of depressing the slidable knob 8 previously described in relation to FIG. 1. Upon depressing the knob 8 downwards, the lever 633 is caused to rotate clockwise as viewed in FIG. 23 to the dotted position shown in FIG. 23*a*. Mounted on the end of the lever 633 is a pawl 634 which is able to rotate relative to the lever 633 only in a clockwise direction A, as viewed in FIG. 23*a*. The pawl 634 is prevented from rotating anti-clockwise relative to the lever 633 by means of an abutment 6332. When the lever 633 pivots through its limited rotational angle, the pawl 634 moves up into engagement with the Maltese Cross 632 and causes the Maltese Cross to rotate anti-clockwise (arrow B) through 90° so as to change the slogan being printed.

When the knob 8 is released, the lever 633 and knob 8 are biassed by springs (not shown) to return to the rest positions shown in FIG. 23. This ensures that when the print drum assembly 60 rotates, the Maltese Cross 632 which forms part of the print drum assembly 60 and therefore rotates therewith does not clash with the pawl 634.

If the knob 8 is kept depressed and the print drum assembly is caused to rotate, the rotation of the Maltese Cross 632 with the print drum 63 merely causes the pawl 634 to rotate clockwise relative to the lever 633, thereby effecting a ratchet action. This ratchet action ensures that an accidental act of keeping the knob 8 depressed does not jam the Maltese Cross 632 and prevent the print drum assembly 60 from rotating.

I claim:

1. A postage meter comprising:

a base, a print drum assembly which includes a print drum and a drum shaft rotatively supported by said base of said postage meter, said print drum including radially positionable value printing elements and said drum shaft having, located in a respective groove therein, a plurality of linearly movable racks connected to said value printing elements in such a manner that linear movement of one rack alters the radial position of a corresponding value printing element, a drive gear assembly contained in a gearbox housing rotatively mounted to said drum shaft such that said gearbox housing is supported by said drum shaft in a cantilevered manner at a point axially along said drum shaft and supportively mounted to said base, said drive gear assembly having:

a plurality of gears rotatively mounted in said gearbox housing, herein called cross-over gears, arranged to independently drive corresponding racks;

said cross-over gears driving a respective one of said racks in said respective groove; and, a drive means for each cross-over gear, each of said drive means including a motor mounted in said gearbox housing and a respective drive connecting means mounted in said gearbox housing for causing said cross-over gear to rotate in response to actuation of said respective motor in a predetermined manner, said respective motor for independently driving a respective one of said cross-over gears in said gearbox housing whereby said motors can cause simultaneous rotation of said cross-over gears about a respective rotation axis common to said cross-cover gears.

2. A combination as claimed in claim 1 in which said drum shaft has two axial grooves symmetrically disposed at opposite ends of said drum shaft diameter, and a first groove thereof contains a plurality of said racks and a second groove thereof contains a plurality of said racks.

3. A combination as claimed in claim 1 in which said drive means comprises: first components including a first gear, a splined shaft, and a first one of the cross-over gears in driven relationship with said splined shaft, said first components being in driving communication with a respective rack; and second components including a second gear, a pair of sleeves surrounding and freely rotatable relative to said splined shaft and a second one of the cross-over gears, said second components being arranged in driving communication with the other of said respective racks, said sleeves being interengaged so that rotation of one causes rotation of the other, there being a first dog engagement between said second gear and one of said pair of sleeves and a second dog engagement between the other of said sleeves and said second cross-over gear, a spring biasing means for urging said sleeves apart.

4. A combination as claimed in claim 1 in which said drive means for driving said racks in said respective groove comprises:

first components including a first gear, a splined shaft, a first sleeve surrounding and freely rotatable relative to said splined shaft, a second sleeve surrounding and freely rotatable relative to said splined shaft and in drive engagement with said first sleeve and a first one of said cross-over gears, said first components being arranged to drive a first one of the cross-over gears, said first components being arranged to drive a first one of said respective racks;

second components including a second gear, a second one of said cross-over gears, said splined shaft being in driving engagement with said second gear and in driven engagement with said second cross-over gear, said second components being arranged to drive a second one of said respective racks; and third components including a third gear, a hollow spacer surrounding and freely rotatable relative to said splined shaft, and a third one of said cross-over gears, said third components being arranged to drive a third one of said respective racks, there being a first dog engagement between said third gear and said spacer and a second dog engagement between said spacer and said third cross-over gear, whereby said third gear is in driving engagement with said spacer and said spacer is in driving engagement with said third cross-over gear.

5. A combination as claimed in claim 4 in which a spring biasing means is disposed to act between said first and second sleeves in such a manner as to urge them apart.

6. A combination as claimed in claim 5 in which said spring biasing means is a helical compression spring which encircles said splined shaft.

7. A combination as claimed in claim 3 in which said splined shaft is located in said gearbox housing by snap-in bearing retainer clips which fixably attach to said gearbox housing and rotatively support said splined shaft.

8. A combination as claimed in claim 1 in which at least one of said gears is an encoder gear which has peripheral gear teeth and, radially inwardly of these, an outer an inner circular array of apertures.

9. A combination as claimed in claim 8 having a plurality of sensors in which said array of apertures cooperate with respective outer and inner light beams of said respective sensors, and in which one outer and one inner aperture are blanked out.

10. A combination as claimed in claim 4 in which said splined shaft is located in said gearbox housing by snap-in bearing retainer clips which fixably attach to said gearbox housing and rotatively support said splined shaft.

* * * * *